US010448149B2

(12) United States Patent
Colich

(10) Patent No.: US 10,448,149 B2
(45) Date of Patent: Oct. 15, 2019

(54) NON-AXISYMMETRIC AND NON-HORN PHASE PLUGS

(71) Applicant: Audeze, LLC, Santa Ana, CA (US)

(72) Inventor: Dragoslav Colich, Orange, CA (US)

(73) Assignee: Audeze, LLC, Santa Ana, CA (US)

( * ) Notice: Subject to any disclaimer, the term of this patent is extended or adjusted under 35 U.S.C. 154(b) by 0 days.

(21) Appl. No.: 15/838,378

(22) Filed: Dec. 12, 2017

(65) Prior Publication Data

US 2018/0124509 A1 May 3, 2018

Related U.S. Application Data

(63) Continuation of application No. 15/693,108, filed on Aug. 31, 2017, and a continuation-in-part of application No. 29/620,577, filed on Feb. 28, 2017, and a continuation-in-part of application No. 29/620,578, filed on Feb. 28, 2017, and a continuation-in-part of application No. 29/620,580, filed on Feb. 28, 2017, and a continuation-in-part of application No. 29/620,579, filed on Feb. 28, 2017.

(60) Provisional application No. 62/600,216, filed on Feb. 15, 2017, provisional application No. 62/495,182, filed on Sep. 1, 2016.

(51) Int. Cl.

| | |
|---|---|
| ***H04R 1/30*** | (2006.01) |
| ***H04R 1/02*** | (2006.01) |
| ***H04R 1/10*** | (2006.01) |
| ***H04R 1/28*** | (2006.01) |
| ***H04R 1/36*** | (2006.01) |
| ***H05B 33/08*** | (2006.01) |
| ***H04R 1/34*** | (2006.01) |

(52) U.S. Cl.

CPC ..... *H04R 1/30* (2013.01); *H04R 1/023* (2013.01); *H04R 1/1016* (2013.01); *H04R 1/2807* (2013.01); *H04R 1/2823* (2013.01); *H04R 1/345* (2013.01); *H04R 1/36* (2013.01); *H05B 33/0848* (2013.01); *H04R 2201/34* (2013.01)

(58) Field of Classification Search

CPC .. H04R 1/1008; H04R 1/1016; H04R 1/2807; H04R 1/2811; H04R 1/2823; H04R 1/30; H04R 1/34; H04R 1/345; H04R 1/36; H04R 2201/34

USPC ..... 381/71.6, 72, 328, 340, 341, 342, 343, 381/370, 380, 382, 408, 431; 379/430; 181/129, 130, 135

See application file for complete search history.

(56) References Cited

U.S. PATENT DOCUMENTS 4,040,503 A * 8/1977 Hino ..... G10K 11/24 181/159

4,157,741 A 6/1979 Goldwater (Continued)

FOREIGN PATENT DOCUMENTS

| | | |
|---|---|---|
| CN | 201893899 | 7/2011 |
| CN | 201893899 A1 | 7/2011 |
| DE | 20 2016 001446 U1 | 5/2016 |

*Primary Examiner* — Huyen D Le

(74) *Attorney, Agent, or Firm* — Wayne Richard Howe

(57) ABSTRACT

Phase plugs (70) and related audio devices (100, 105) and methods comprise various compression members (2), and guides (120) extending from the compression members (2) to tips (84), are configured such that central axes (93, 99) defined perpendicular to compression members (2) and/or diaphragms (94) are asymmetric and/or non-axisymmetric to the central axes (93, 99).

26 Claims, 26 Drawing Sheets

(56) References Cited

U.S. PATENT DOCUMENTS

| | | | | |
|---|---|---|---|---|
| 4,875,233 | A * | 10/1989 | Derhaag | H04M 1/05 379/430 |
| 4,985,925 | A * | 1/1991 | Langberg | G10K 11/178 381/71.6 |
| 5,850,461 | A * | 12/1998 | Zelinka | H04R 7/22 381/398 |
| 6,775,390 | B1 * | 8/2004 | Schmidt | H04M 1/05 181/128 |
| 8,887,862 | B2 | 9/2014 | Hughes, II | |
| 8,976,994 | B2 | 3/2015 | Howes et al. | |
| 9,264,789 | B2 | 2/2016 | Donarski | |
| 2005/0105753 | A1 | 5/2005 | Manzini et al. | |
| 2007/0147647 | A1 * | 6/2007 | Voishvillo | H04R 1/30 381/343 |
| 2012/0328144 | A1 * | 12/2012 | Dugger | H04R 1/1033 381/384 |
| 2013/0228393 | A1 | 9/2013 | Sterling et al. | |
| 2013/0243232 | A1 | 9/2013 | Dimitrov | |
| 2014/0140565 | A1 | 5/2014 | Liu | |
| 2015/0086057 | A1 | 3/2015 | Christner et al. | |
| 2015/0373445 | A1 | 12/2015 | Voishvillo | |
| 2016/0014503 | A1 | 1/2016 | Oclee-Brown | |
| 2016/0119711 | A1 | 4/2016 | DeLay et al. | |
| 2016/0142824 | A1 * | 5/2016 | Clark | H04R 7/14 381/423 |
| 2016/0173989 | A1 * | 6/2016 | Jacques | H04R 7/04 381/419 |
| 2016/0295315 | A1 * | 10/2016 | Kuwahara | H04R 1/1016 |

* cited by examiner

Side View
(Planar Compression Member)

Side View
(Convex Compression Member)

Side View
Concave C.M.
Sharper tip [84]

Side View
(Planar Compression Member Shortest Path Surface Measurements)

(Isometric View
Planar Compression Member)

Side View
(Planar Compression Member with Internal Waveguides)

Isometric View (Planar Compression Member and Internal Waveguides)

Isometric View (Planar Compression Member with Internal Waveguides)

Side View
(Planar Compression Member); Audio Device (Non-Axisymmetric – One Housing)

Non-Axisymmetric – Releasably Attachable Upper Housing

Side View
(Releasably Attachable Upper Housing with Concave Compression Surface)

Isometric View with Planar Compression Member

Side View
(Planar Compression Member and Non-Rectilinear Line)

Side View
(Convex Planar Compression Member)

Side View
(Concave Compression Member)

Side View
(Semi-sphere Compression Member)

Side View
(Planar Compression Member with Coplanar Slopes)

Side View
(Planar Compression Member with Intersecting Plane Slopes)

Side View – Non-axisymmetric Phase Plug Horn-free Audio Device (No Horn)

Side View – Symmetric Phase Plug Horn-free Audio Device (No Horn)

Side View
(Planar Compression Member); Audio Device (Non-Axisymmetric – From Provisional Arc Member 404
Earhook Spoke 403
Flexible Partial Ring 401
Annular Indentation Ring 402
Bottom Housing 15
Earhook 170

Side View
(Earhook, Concha Ring)

Side Views

With Non-axisymmetric Phase Plug (Fazor™) Frequency response shows high frequency is well extended and smooth.

Phase Response is also very smooth.

Graph shows extremely low Distortion level (Total Harmonic Distortion), due to Fluxor Magnets, planar diaphragm, and Phase Plug (Fazor) implementation.

Without Non-axisymmetric Phase Plug (Fazor™) the same earphones exhibit poor frequency response, peaky high frequencies and faster roll-off. Phase response suffers above 1000Hz.

NON-AXISYMMETRIC AND NON-HORN PHASE PLUGS

CROSS-REFERENCE TO RELATED APPLICATIONS

This application is a continuation and claims the benefit of U.S. patent application Ser. No. 15/693,108, filed Aug. 31, 2017, which claims the benefit of U.S. Provisional Application No. 62/495,182, filed Sep. 1, 2016. This application is a continuation and claims the benefit of U.S. patent application Ser. No. 15/693,108, filed Aug. 31, 2017, which claims the benefit of U.S. Provisional Application No. 62/600,216, filed Feb. 15, 2017. This application is a continuation and claims the benefit of U.S. patent application Ser. No. 15/693,108, filed Aug. 31, 2017, which is a continuation-in-part and claims the benefit of Application No. 29/620,577, filed Feb. 28, 2017. This application is a continuation and claims the benefit of U.S. patent application Ser. No. 15/693,108, filed Aug. 31, 2017, which is a continuation-in-part and claims the benefit of application Ser. No. 29/620,578, filed Feb. 28, 2017. This application is a continuation and claims the benefit of U.S. patent application Ser. No. 15/693,108, filed Aug. 31, 2017, which is a continuation-in-part and claims the benefit of application Ser. No. 29/620,579, filed Feb. 28, 2017. This application is a continuation and claims the benefit of U.S. patent application Ser. No. 15/693,108, filed Aug. 31, 2017, which is a continuation-in-part and claims the benefit of application Ser. No. 29/620,580, filed Feb. 28, 2017.

The entirety of these aforementioned applications are not admitted to be prior art with respect to the present invention by their mention in the cross-reference or background sections.

BACKGROUND

Field

The disclosure relates to devices, methods, and systems relating to phase plugs, phase-shifting, and phase coherence of acoustic signals in loudspeakers, headphones, earphones, in-ear earphones, and other acoustical devices. The disclosure also relates to devices, methods, and systems for disassembling, disengaging, or releasably attaching housings and sound ports for acoustical devices. The disclosure also relates to removable ear hooks or concha rings in attachment, support, and removal of audio devices from the ear.

Description of the Related Art

In an acoustical loudspeaker, a phase plug, phasing plug, or acoustical transformer is a mechanical interface between a speaker driver and the audience. A phase plug matches acoustical impedance, enables waveform phasing coherence, and/or suppresses high frequency standing waves at the compression driver. The phase plug extends high frequency response by guiding sound waves outward toward the listener in-phase rather than allowing them to interact destructively near the driver.

Phase plugs are traditionally found in high-powered horn loudspeakers used in professional audio, in the mid- and high-frequency band passes, positioned between the compression driver diaphragm and the decompression horn. Phase plugs may also be present in front of woofer cones in some loudspeaker designs. In each case they serve to equalize sound wave path lengths from the driver to the listener, to prevent cancellations and frequency response problems. The phase plug can be considered a further narrowing of the horn throat, becoming an extension of the horn to the surface of the diaphragm.

Information relevant to conventional phase plugs, compression surfaces, waveguide surfaces, compression drivers, waveguides, phase plugs with woofer cones, phase plugs with endpoints or tips feeding into the throat of decompression horns, symmetrical phase plugs, symmetrical waveguides, symmetrical phase plug endpoints or tips, and phase plugs with multiple waveguides can be found in U.S. Pat. Nos. 4,157,741; 8,887,862; 8,976,994; 9,264,789; U.S. Patent Application No. 2005/0105753; U.S. Patent Application No. 2014/0140565; U.S. Patent Application No. 2015/0373445; and U.S. Patent Application No. US 2016/0014503.

There is a continuous need for improvements in speakers, headsets, earphones, in-ear acoustic devices, hearing aids, earbuds, and other devices.

SUMMARY

A phase plug (70) also variously called a phasing plug, a phasing member, an acoustical transformer, an acoustical impedance matcher, or a Fazor™ comprises three elements. These elements generally include: the compression member (2) also variously called the compression surface; the guide (120) also variously called the guide surface, or the waveguide surface; and the tip (84) also variously called the phase plug tip, the phase plug endpoint, the coherence tip, the coherence point, or the coherence locus.

The compression member (2) is the part of the phase plug placed next to or adjacent to the diaphragm (94) also variously called the transducer diaphragm, the speaker diaphragm, or the driver diaphragm. The compression member (2) is generally shaped similarly to the diaphragm (94), thus forming a compression cavity where the sound waves are compressed and decompressed at audio frequencies. The compression member (2) may be planar, concave, convex, or any other shape generally conforming to or in conformance with the diaphragm (94).

The guide (120) is the surface over which the sound waves travel after leaving the compression cavity. The sound waves generally travel over or next to the guide (120) or through the waveguide (85) to the phase plug tip (84).

Traditionally, the phase plug tip (84) is generally located at the endpoint of the phase plug (70), where the sound waves converge ordinarily in phase with each other. The phase plug tip (84) generally terminates proximate to an acoustic opening (60) located at the throat of or entrance to a horn (106). In an aspect, the phase plug tip (84) terminates proximate to an acoustic opening (60) without a throat or entrance to a horn (106).

Traditionally, the compression member (2) and the guide (120) have been: (a) symmetrical around a compression member central axis (93) defined perpendicularly to the compression member (2), and/or (b) symmetrical about a central axis (99) defined perpendicularly to a compression member periphery (16) or diaphragm (94). This symmetry around an axis is generally called symmetric or axisymmetric. One novel unobvious improvement to phase plugs, and an aspect of the present invention, can be accomplished by designing the phase plug to be non-symmetrical, also variously called asymmetrical, asymmetrical about an axis, non-axisymmetric, or non-axisymmetrical. Advantages to these novel and unobvious non-axisymmetric phase plugs include the ability to bend sound waves through non-axisymmetric waveguides which may fit into a non-axisymmetric space, one example of which is an ear canal.

Traditionally sound waves have been guided through waveguides that are formed between a housing inner wall and a phase plug guide. Traditionally, after the sound waves reach the tip of the phase plug and/or endpoint of the waveguide, the sound waves rejoin and cohere to be substantially in phase, where they are then guided into the throat of a horn. These horns traditionally increase in size from the throat to the mouth of the horn, so that the sound waves can expand or decompress to cover a broader area. Novel, unobvious improvements can be made to these phase plug devices by eliminating the phase plug-horn combination, so that the sound waves come directly out of the phase plug waveguide without having to expand or decompress through a horn. This unobvious "anti-horn", "non-horn", "a-horn", "devoid of a horn", or "horn-free" device, system, and design approach traditionally has not been used with phase plugs, horns, and their acoustical housings. This unobvious approach of phase plugs without horns has useful advantages in environments where sound waves do not need to be spread out or decompressed. One such exemplary application is when disposed in ear canals.

Other aspects are directed to devices, methods, and systems that satisfy the needs as defined in the background section and to improve audio quality.

Thus, in one aspect, a phase plug (70) comprises a compression member (2) and a guide (120). The compression member has a central perpendicular axis (93). The guide (120) extends from the compression member (2) to a phase plug tip (84), such that the guide (120) is non-axisymmetric to the central axis (93) of the compression member. This novel and unobvious non-axisymmetric phase plug and housing shape is useful in several applications, including ear canals.

In another aspect, the phase plug tip (84) is not located on the central perpendicular axis (93).

In another aspect, the phase plug tip (84) has a cross section (95) that is perpendicular to the guide (120) where the cross section (95) has a smaller area than the area of the compression member (2).

In another aspect, the novel and unobvious non-axisymmetric phase plug (70) has a compression member surface shape (2) that is planar or substantially planar. This compression member surface shape (2) may also be substantially convex, concave, or any other shape.

In another aspect, the guide (120) of non-axisymmetric phase plug (70) is shaped so that shortest path surface measurements (19*a*, 19*b*, 19*c*, 19*d*, 19*e*) when measured along the shortest surface paths on the guide (120) from the tip (84) to the compression member (2) are substantially the same distance.

In another aspect, the phase plug (70) may comprise an internal waveguide (27) disposed inside the phase plug (70).

In another aspect, the phase plug (70) may comprise a plurality of internal waveguides (27) inside the phase plug (70) such that the internal measurements along the shortest paths inside the plurality of waveguides (27) are substantially the same distance. In one aspect, the waveguides may all be inside the phase plug and travel from the compression member (2) to the phase plug tip (84). Alternatively, the waveguides (27) may begin at the compression member (2) and travel internally in the guide for a distance before emerging from the side of the guide (120), such that the entire distance from the compression member internally through the waveguide (27) and out to the guide (120) and then to the phase plug tip (84) is substantially the same distance as the normal guide (120) distance. Alternatively, the waveguide (27) may begin in the side of the guide (120), then travel through the phase plug (70) as an internal waveguide (27), and then emerge from the phase plug (70) either out of the side of the guide (120) or out of the tip (84), so that the entire distance of the various waveguides are substantially the same distance.

In another aspect, the waveguides (27) internal to the phase plug may be tunnels (21) through the phase plug (70), annular rings (22) through the phase plug (70), radial waveguides (23) through the phase plug (70), spirals (24) through the phase plug (70), asymmetric waveguides (25) through the phase plug (70), or non-axisymmetric waveguides (26) through the phase plug (70).

Another aspect is an audio device (100) containing a non-axisymmetric phase plug (70).

In another aspect, a non-axisymmetric phase plug (70) comprises a compression member (2) configured to have shapes similar to the transducer (speaker) diaphragm. In this aspect, the compression member (2) comprises a compression member periphery (16) (a border or boundary). The guide (120) then extends from the compression member periphery (16) to the phase plug tip (84). In this aspect, the guide (120) has a plurality of cross-sectional areas (10-14) that are substantially parallel to the compression member periphery (16). Each cross-sectional area (10-14) of the phase plug has a center point (5-9) so that a successive (sequential) tracing of the cross-sectional area center points (5-9) from the compression member (2) to the tip (84) defines a non-rectilinear line (115).

Another aspect is an audio device (100) which includes a phase plug whose cross-sectional areas comprise center points which successively define a non-rectilinear line (115).

In another aspect, a phase plug (70) comprises a compression member (2) having a periphery (16) (perimeter), and a guide (120) which extends from the compression member periphery (16) (perimeter) to the phase plug tip (84). The guide has a planar perimeter (83) substantially parallel to the periphery (16), and the guide (120) is configured so that coplanar slopes (64, 74) of the perimeter (83) (the slopes around the perimeter of the guide) are unequal.

Another aspect is an audio device (100) which includes the phase plug in which coplanar slopes (64, 74) of the planar perimeter (83) substantially parallel to the periphery (16) are unequal. In this aspect, the shape of the compression member (2) conforms to the shape of a corresponding transducer diaphragm (94).

Another aspect is a phase plug (70) where the compression member (2) has a compression member periphery (16) which defines a compression member periphery plane (91), and where intersecting planes (85, 86, 87, 88) parallel to the compression member periphery plane (91) intersect the guide (120), so that at least one front slope (65, 66, 67, 68) of guide (120) at planes (85, 86, 87, 88) is unequal to its opposite side rear slope (75, 76, 77, 78) of guide (120). In another aspect of this invention, the shape of the compression member (2) conforms to the shape of a corresponding transducer diaphragm (94).

In another aspect, various aspects of the shape of the phase plug tip (84) may modified to control the acoustic effects or other characteristics desired with the phase plug tip (84). Thus, the phase plug tip may be pointed, dully pointed, sharply pointed, rounded, beveled, square, or even have fins, ailerons, ridges, or channels to increase, decrease. or modify phase coherence.

Another aspect is an audio device (100) comprising: a housing (101) having a first acoustic opening (60); a transducer assembly (90) disposed in the housing (101), such that the transducer assembly (90) is located distal to the first acoustic opening (60), and wherein the transducer assembly (90) further comprises a diaphragm (94), such that the diaphragm (94) defines a central axis (99) perpendicular thereto; and a phase plug (70) disposed within the housing (101) between the diaphragm (94) and the first acoustic opening (60), such that the phase plug (70) is non-axisymmetric with the central perpendicular axis (99).

In another aspect, the audio device (100) with the non-axisymmetric phase plug (70) has a housing (101) comprised of a top housing (110) variously called the housing distal from the listener (110) or distal from the ear canal (110) and a bottom housing (15) variously called the housing proximate to the listener (15), the housing proximate to the ear canal (15) including the sound port (17), such that the top housing (110) is releasably attachable to the bottom housing (15). This is useful for disassembling in-ear earphone devices (105) for substitution of the top housing onto various shapes of bottom housings and sound ports, such as fitting different ears.

In another aspect, the bottom housing (15) comprises the location where the transducer is installed.

In another aspect, a sound port (17) is an extension of the bottom housing (15) for transferring sound into the ear canal.

In one aspect, the sound port (17) and the bottom housing (15) are the same part. In another aspect, the sound port (17) and the bottom housing (15) are separate parts.

In another aspect, the housing (101) is open, semi-closed, or closed.

In another aspect, the transducer assembly (90) is planar magnetic.

In another aspect, the acoustic opening (60) of the audio device (100) has a center point (198) that is not located on the central perpendicular axis (99).

In another aspect, the audio device (100) with the non-axisymmetric phase plug (70) has a hollow housing (101) that includes an inner wall (111), such that a waveguide (85) is defined between the inner wall (111) and the guide (120). In this aspect of the invention the shortest path measurements of the waveguide (85) from points on the compression member periphery (16) to the first acoustic opening (60) are substantially the same. This is useful because having the same distances for the non-axisymmetric waveguides means the sound waves travel the same distances through the non-axisymmetric waveguides, so the sound waves will all cohere in-phase at the phase plug tip.

In another aspect, the audio device (100) with the non-axisymmetric phase plug (70) has waveguides disposed internally to the phase plug (70).

In another aspect, a horn-free audio device (200), comprises a housing (101) having a first acoustic opening (60); a transducer assembly (90) being disposed on the housing (101), such that the transducer assembly (90) is located distal to the first acoustic opening (60); and a phase plug (70) disposed within the housing (101) between the transducer assembly (90) and the first acoustic opening (60), such that the acoustic opening (60) is free of a horn (106).

In another aspect, the horn-free audio device (200) has a phase plug (70) including a compression member (2) with a periphery (16) having a central axis (93) that is perpendicular to the compression member (2); where the phase plug tip (84) is distal to (far from) the compression member (2) and proximate (near) to the first acoustic opening (60); and where the housing (101) of the horn-free device includes an inner wall (111), so that a waveguide (85) is formed between the inner wall (111) and the phase plug guide (120) so that the shortest path measurements of the waveguide (85) from points on the compression member periphery (16) to the first acoustic opening (60) are substantially the same distance.

In another aspect, the central axis (93) perpendicular to the compression member periphery (16) in the horn-free audio device (200), the phase plug (70) can be symmetric around the central axis (93), axisymmetric around the central axis (93), or non-axisymmetric around the central axis (93).

In another aspect, the horn-free audio device (200) the transducer assembly (90) generates sound waves onto the compression member (2) and through the waveguide (85) to the first acoustic opening (60) where the sound waves are substantially phase coherent at the first acoustic opening (60).

In another aspect, the horn-free audio device (200) housing (101) comprises a second opening (202), such that the second opening (202) can be open, semi-closed, or closed.

In another aspect, the horn-free audio device (200) has an earhook (170) comprising: a flexible partial ring (401) releasably attachable to an annular indentation ring (402) on the bottom housing (15); a spoke (403) having two ends, such that the first end of the spoke (403) is attached to the flexible partial ring (401); and an arc member (404), such that the concave section of the arc member (404) is disposed on the second end of the spoke (403), such that the arc member (404) fits into and adheres to a human ear concha.

Another aspect is a method for generating sound waves, comprising: compressing and decompressing air at an audio frequency between a transducer diaphragm (94) and a compression member (2) such that sound waves are produced therein; impelling the sound waves through a non-axisymmetric waveguide (85); converging the sound waves at a coherence tip (84) of the non-axisymmetric waveguide (85); and emitting the sound waves through an acoustic opening (60), such the sound waves emit substantially in phase.

Another aspect is a method for producing sound waves, comprising: vibrating air at an audio frequency between a transducer diaphragm (94) and a compression member (2); guiding the vibrating air through a waveguide (85); converging the vibrating air at a phase plug coherence tip (84); and emanating the vibrating air substantially in phase through an acoustic opening (60), such that the acoustic opening (60) is free of a horn.

Another aspect is a closed acoustical system. This comprises: a closed earphone comprising a non-axisymmetric phase plug (70) and an acoustic opening (60); and an ear tip (160) sealed acoustically to the acoustic opening (60), where the ear tip (160) is configured such that when inserted in a human ear an acoustic seal is formed between the ear tip circumference and the ear canal, such that a closed acoustic system is formed between the earphone and the ear drum.

Another embodiment includes an in-ear audio device comprising: a tapered hollow sound port (17) with a tapered external surface (20) or housing outer wall (20) for coupling into an ear canal; an internal generally-conical tapered element (70) (alternatively, a phase shifting element, phase-shift plug, or Fazor™) suspended within the tapered hollow sound port by one or more spokes (80) connecting the internal generally-conical tapered element to the tapered hollow sound port, wherein at least one waveguide (85) is formed between the internal generally-conical tapered element and the internal tapered surface of the tapered hollow sound port; and an electro-acoustic transducer assembly (90) mounted around the rim of the large opening of the tapered hollow sound port.

A further embodiment comprises a top housing (110) mounted around the rim of the sound port (17) or bottom horn (15) at the large opening in the tapered hollow sound port.

A further embodiment comprises multiple internal generally-conical tapered elements.

A further embodiment comprises various types of electro-acoustic transducer assemblies (90), including dynamic, planar, planar magnetic, cone voice coil, dome voice coil, electrostatic, and piezo electric transducers.

A further embodiment comprises inner and/or outer damping material surrounding the electro-acoustic transducer assembly.

A further embodiment comprises an ear tip (160) positioned around the small hole in the tapered hollow sound port (17).

A further embodiment comprises a concha ring or ear hook (170) which is fixed to or detachable from the sound port.

A further embodiment comprises making the electro-acoustic transducer assembly (90) removable from the sound port (17), so that it is replaceable by a different electro-acoustic transducer assembly.

A further embodiment comprises making the top housing (110) removable from the sound port (17), so that it is replaceable with a different top housing.

A further embodiment comprises making the top housing (110) and the electro-acoustic transducer assembly (90) as a unit, such that the entire unit is removable and replaceable by a different top housing and transducer assembly.

One method comprises the step of reforming the bottom assembly (15) such that the in-ear device phase-shifts the acoustic signals for different acoustic qualities, such as frequency response, decreased sound diffraction, improved acoustic loading, improved reflection characteristics, and decreased sound distortion.

Another method comprises the step of reforming the internal generally-conical tapered element (70) such that the in-ear device phase-shifts the acoustic signals for different acoustic qualities, such as frequency response, decreased sound diffraction, improved acoustic loading, improved reflection characteristics, and decreased sound distortion.

Another embodiment comprises a system of interacting and adjustable parts such that the in-ear device interactively phase-shifts the acoustic signals for different acoustic qualities, such as frequency response, decreased sound diffraction, improved acoustic loading, improved reflection characteristics, and decreased sound distortion.

An aspect of an embodiment comprises an in-ear audio device (105) comprising: a tapered hollow sound port (17) with a tapered external surface (20) for coupling into an ear canal, a first large opening (50) directed away from the eardrum, a second smaller opening (60) directed toward the eardrum, and an internal tapered surface (30) forming an internal tapered cavity (40) such that the internal tapered cavity (40) of the tapered hollow sound port (17) tapers internally from the first large opening (50) toward the second smaller opening (60).

Another aspect comprises an in-ear audio device (105) comprising: an internal generally-conical tapered element (70) also called a phase shifting element (70), a phase-shift plug (70), a Fazor™ (70), and a phase plug (70) suspended within the tapered hollow sound port (17) by one or more spokes (80) connecting the internal generally-conical tapered element (70) to the tapered hollow sound port (17), such that the tapering of the internal generally-conical tapered element (70) and the tapering of the tapered hollow sound port (17) point in the same general direction toward the second smaller opening (60), and wherein at least one waveguide (85) is formed between the internal generally-conical tapered element (70) and the internal tapered surface (30) of the tapered hollow sound port (17).

Another aspect comprises an in-ear audio device (105) comprising: an electro-acoustic transducer assembly (90) mounted around the rim of the large opening (50) of the sound port (17) and bottom housing (15).

Another aspect comprises an in-ear audio device (105) wherein the electro-acoustic transducer assembly (90) may comprise magnets (92), diaphragm (94), and diaphragm frame (96).

Another aspect comprises an in-ear audio device (105) wherein a top housing (110) is mounted around the rim of the bottom housing (15) at the first large opening (50) and the electro-acoustic transducer assembly (90).

Another aspect comprises an in-ear audio device (105) wherein the type of top housing (110) may be selected from the group consisting of open, closed, and semi-closed.

Another aspect comprises an in-ear audio device (105) wherein the internal tapered surface (30) of the tapered hollow sound port (17) is smooth.

Another aspect comprises an in-ear audio device (105) wherein the tapered edges of the generally-conical tapered element (70) are smooth.

Another aspect comprises an in-ear audio device (105) wherein the internal generally-conical tapered element (70) comprises multiple internal generally-conical tapered elements.

Another aspect comprises an in-ear audio device (105) wherein the outer surface (120) of the internal generally-conical tapered element (70) may be selected from the group comprising a flat upper surface (2), a convex upper surface (2), and a concave upper surface (2).

Another aspect comprises an in-ear audio device (105) wherein the tapered surface (120) of the internal generally-conical tapered element (70) may be selected from the group comprising exponentially tapered, conically tapered, and hyperbolically tapered.

Another aspect comprises an in-ear audio device (105) wherein the electro-acoustic transducer assembly (90) may be selected from the group consisting of dynamic, planar, planar magnetic, cone voice coil, dome voice coil, electrostatic, and piezo electric transducer.

Another aspect comprises an in-ear audio device (105), further comprising inner damping material (140) attached between the electro-acoustic transducer assembly (90) and the internal generally-conical tapered element (70).

Another aspect comprises an in-ear audio device (105) wherein inner damping material (140), further comprises outer damping material (150) placed between the internal generally-conical tapered element (70) and the top housing (110).

Another aspect comprises an in-ear audio device (105), further comprising an ear tip (160) positioned around the second small opening (60) of the tapered hollow sound port (17).

Another aspect comprises an in-ear audio device (105) wherein the ear tip (160) may be selected from the group comprising silicone, rubber, and foam.

Another aspect comprises an in-ear audio device (105), further comprising that the mounting of the electro-acoustic transducer assembly (90) around the rim of the large opening (50) is sealed.

Another aspect comprises an in-ear audio device (105), further comprising a concha ring or ear hook (170) attached to the sound port (17) or bottom housing (15).

Another aspect comprises an in-ear audio device (105) wherein the concha ring or ear hook (170) is detachable from the sound port (17) or bottom housing (15).

Another aspect comprises an in-ear audio device (105) wherein the electro-acoustic transducer assembly (90) is removable from the bottom housing (15), and replaceable by a different electro-acoustic transducer assembly.

Another aspect comprises an in-ear audio device (105) wherein the top housing (110) is removable from the sound port (17), and replaceable with a different top housing.

Another aspect comprises an in-ear audio device (105) wherein the top housing (110) is joined to the electro-acoustic transducer assembly (90) as a unit, which is removable and replaceable by a different unit.

Another aspect comprises an in-ear audio device (105), further comprising sound port damping material (195) near the smaller end (60) of the sound port.

Another aspect comprises an in-ear audio device (105) wherein the sound port damping material (195) is placed inside the smaller opening (60).

Another aspect is an audio device for the ear comprising: a hollow housing (101) providing a first acoustic opening (60); a transducer (90) disposed at the distal region of the housing (101); and a phase-controlling member (70) disposed within the housing (101) between the transducer (90) and the first opening (60); the phase-controlling member (70) being configured such that the member (70) provides control of acoustic phasing from the transducer (90) to the first opening (60).

Thus, these novel and unobvious aspects provide improved audio performance, such as: improved frequency response, phasing, and phase coherence; decreased sound diffraction; improved acoustic loading; improved reflection characteristics; and decreased sound distortion—while at the same time enabling a non-axisymmetric fitting into an awkwardly shaped ear canal. Present embodiments satisfy these and other needs and provide further related advantages.

BRIEF DESCRIPTION OF THE DRAWINGS

These and other features, aspects, and advantages will become better understood with regard to the following description, appended claims, and accompanying drawings where:

FIG. 23*a* shows the internal generally-conical tapered element or Fazor™ (70) integrated with the Sound port (17) and secured with spokes (80).

FIG. 23*b* illustrates an embodiment where both the Fazor™ (70) and sound port are detachable from the Sound port (17).

FIG. 23*c* illustrates the sound port without the Fazor™ (70).

FIG. 23*d* shows the outer surface (120) of the Fazor™ (70) or guide (120) and the inner surface (30) of the sound port essentially in parallel.

FIG. 23*e* shows the outer surface (120) of the Fazor™ (70) or guide (120) and the inner surface (30) of the sound port generally expanding.

FIG. 23*f* shows the outer surface (120) of the Fazor™ (70) or guide (120) and the inner surface (30) of the sound port generally contracting.

DETAILED DESCRIPTION

In the Summary above, in this Detailed Description, in the claims below, and in the accompanying drawings, reference is made to particular features (including method steps). It is to be understood that the disclosure in this specification includes all possible combinations of such particular features. For example, where a particular feature is disclosed in the context of a particular aspect or embodiment, or a particular claim, that feature can also be used, to the extent possible, in combination with and/or in the context of other particular aspects and embodiments.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Figure 1:
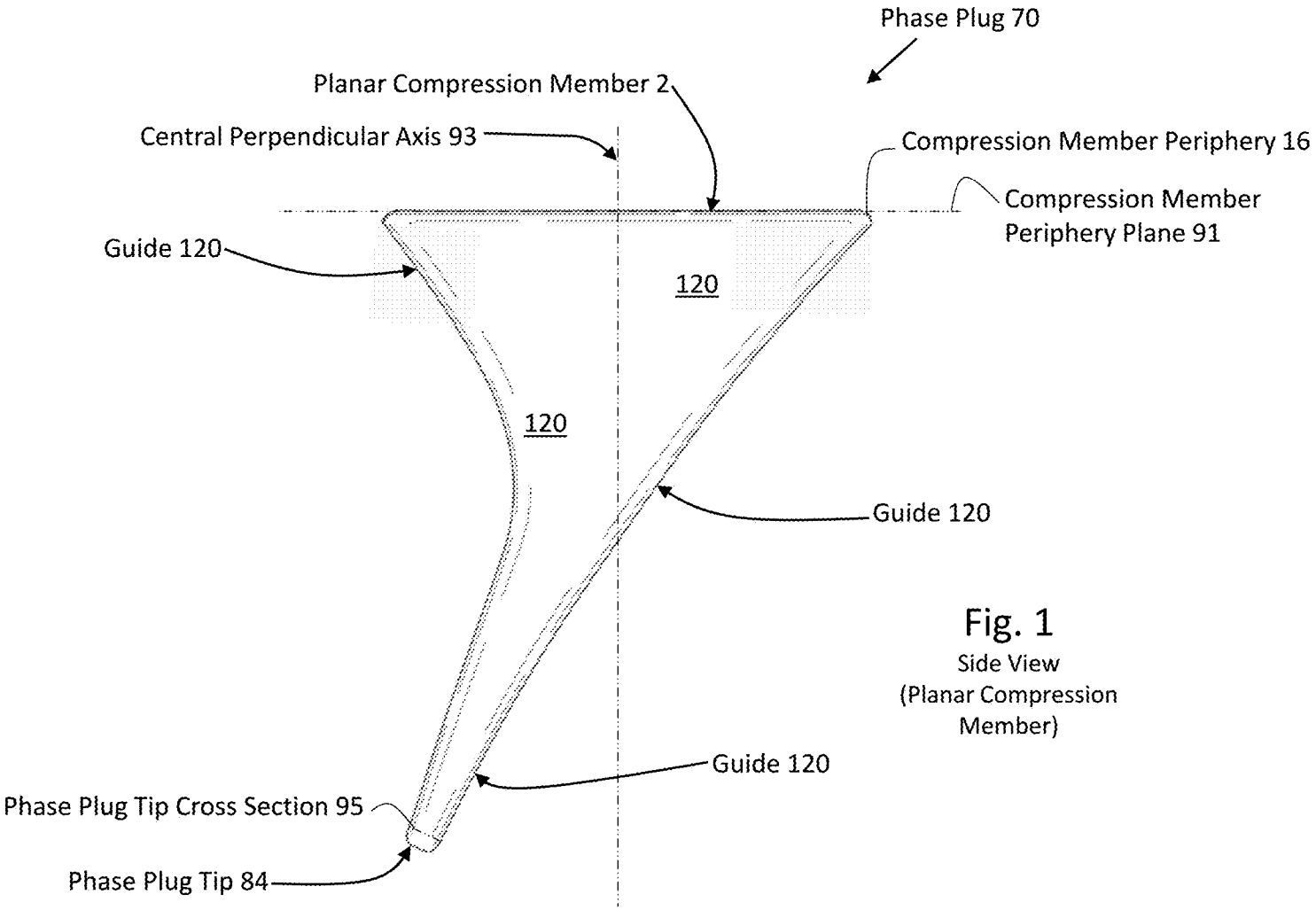
FIG. 1 shows a side view of a phase plug (70) with a planar compression member (2).

Traditionally phase plugs are symmetric about an axis (axisymmetric) of the speaker diaphragm or of the compression member. FIG. 1 shows an exemplary side view of a novel non-axisymmetric phase plug (70). This phase plug (70) is comprised of three primary elements, the compression member (2), the guide (120), and the phase plug tip (84). In FIG. 1, the compression member (2) is flat or planar and is generally configured to be used with a diaphragm (not shown) that is planar or flat, such that the flat driver diaphragm strongly compresses air between the diaphragm and compression member in what is called a compression cavity. In FIG. 1, a central perpendicular axis (93) is defined such that the axis is at the center point of the compression member and perpendicular to it. In a traditional phase plug, the guide ((120) would circumvent or rotate about this axis (93). However, as FIG. 1 shows, the non-axisymmetric characteristics of this novel and unobvious phase plug cause the guide (120) to rotate about the axis (93) in a non-symmetric way. In addition, the phase plug tip (84) also would traditionally lie along the central perpendicular axis (93). However, the novel and unobvious non-axisymmetric phase plug (70) causes the phase plug tip (84) to lie outside of the central perpendicular axis as well.

Thus, FIG. 1 illustrates one aspect of the non-axisymmetrical phase plug (70): (1) that the guide does not axisymmetrically rotate around the perpendicular axis, and (2) that the phase plug tip also does not rotate axisymmetrically around the perpendicular axis.

In addition, FIG. 1 also shows an aspect of a cross-sectional area (95) of the phase plug at the phase plug tip (84). In this aspect, this cross-sectional area is shown to be smaller than the compression member of the phase plug so that the sound waves traveling over the guide (120) can converge at the phase plug tip in a smooth manner thus enabling the sound waves to converge in phase, providing that the distance that the sound waves have traveled are substantially the same.

FIG. 1 also shows a compression member periphery (16) which acts as an edge or border to the compression member. The air is generally compressed between the diaphragm and the compression member, which forces the air over the periphery or edge and into the guide area (120) of the phase plug. FIG. 1 also defines a compression member periphery plane 91, which in FIG. 1 describes the planar aspect of the planar compression member.

Figure 2:
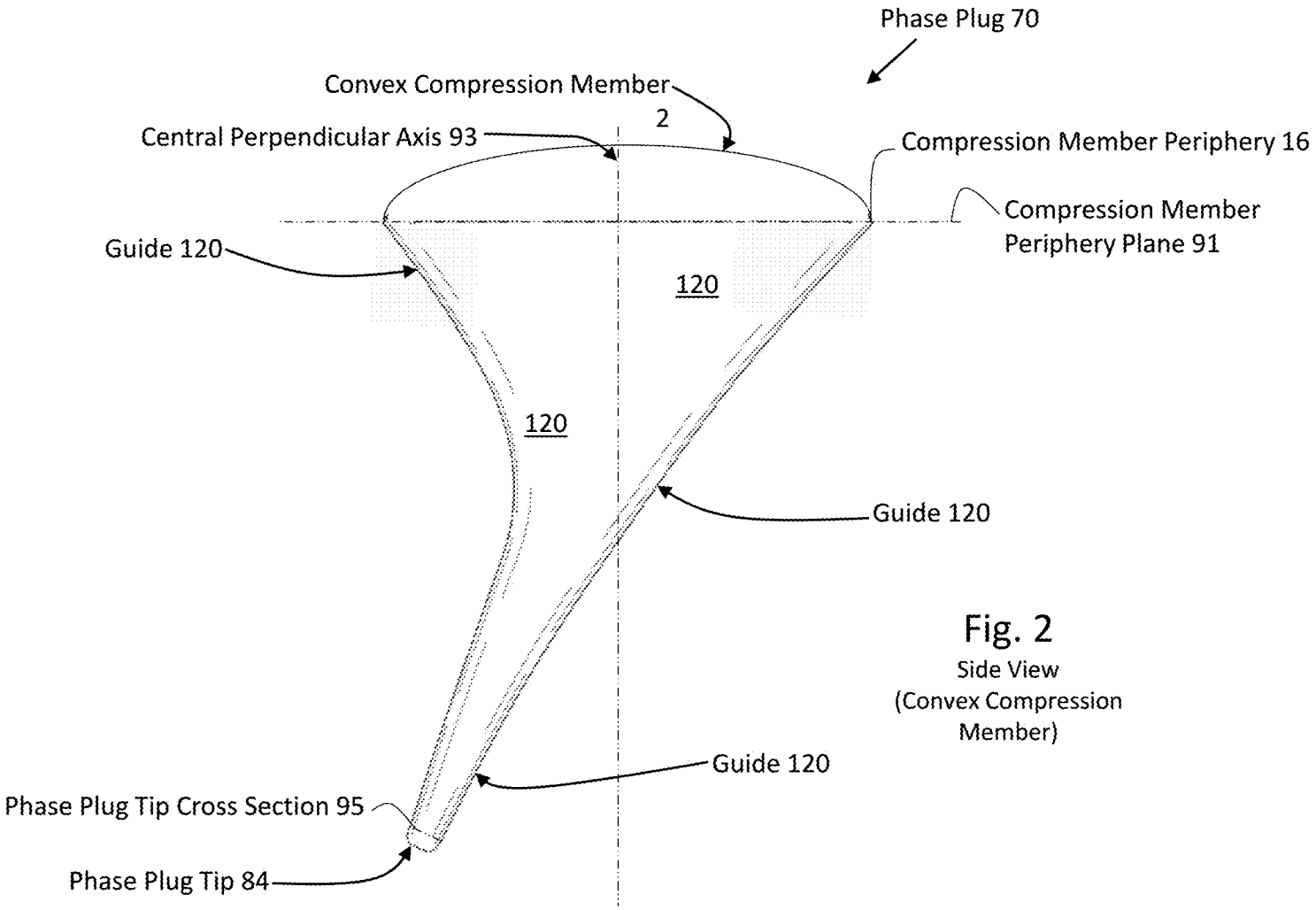
FIG. 2 shows a side view of a phase plug (70) with a convex compression member (2).

However, in distinction to the planar compression member (2) in FIG. 1, FIG. 2 shows an exemplary phase plug (70) with a convex compression member (2). This convex compression member is designed so that it is shaped in conformance with a similarly shaped diaphragm, such as an inverted dome diaphragm. Thus, with the shapes of the convex compression member being in conformance with the diaphragm, a compression cavity may also be formed with a convex compression member to compress the air and drive it over the compression member periphery (16).

FIG. 2 shows a compression member periphery (16) at the periphery or edge of where the convex compression member ends and where the guide (120) begins. Despite the fact that the convex compression member (2) is not flat, the compression member periphery (16) also defines a compression member periphery plane (91) such that the perpendicular axis (93) is formed at the center of the compression member periphery (16) and is perpendicular to the compression member periphery plane (91). Thus, this describes out axis around which traditional phase plugs would be symmetric or axisymmetric. As FIG. 2 shows, the same non-axisymmetric standards apply, namely that the guide (120) is not symmetric about the axis (93), nor is the phase plug tip axisymmetric about the central perpendicular axis (93).

Figure 3:
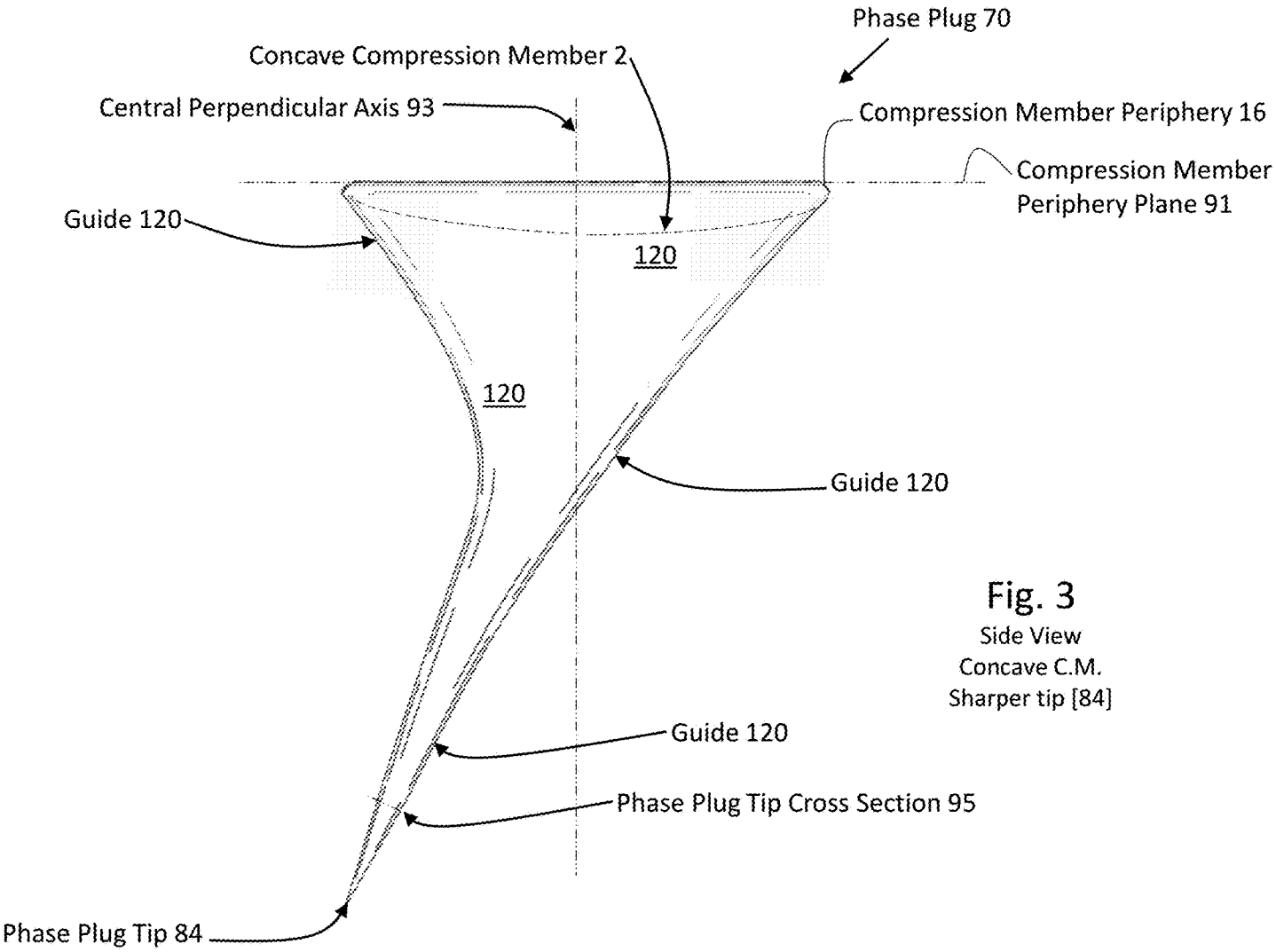
FIG. 3 shows a side view of a phase plug (70) with a concave compression member (2).

FIG. 3 shows an exemplary phase plug (70) in which the compression member (2) is concave, as indicated by the dashed line showing the concavity behind the compression member periphery (16). Similar to the convex compression member, the concave compression member is shape din conformance with a diaphragm such as a dome diaphragm. In this way, a compression cavity is also formed, with the compressed air being forced over the compression member periphery (16) to the guide surface (120).

FIG. 3 also shows a compression member periphery plane (91) that is defined from the compression member periphery (16). Thus, the central perpendicular axis (93) in this case is defined to be at the center of the concave compression member periphery (16) and perpendicular to the compression member periphery plane (91). As in the previous two examples, both the guide (120) and the phase plug tip (84) are non-axisymmetric about the central perpendicular axis (93).

FIG. 3 also shows the flexibility that may be obtained in the design of the phase plug tip (84). In FIG. 3, the phase plug tip (84) is designed to have a sharper point, as opposed to the previous two examples. Thus, various styles of phase plug tips may be defined as desired. Although phase plug compression members (2) in the Figures show a generally dome-shaped, inverse-dome, planar, or spherical compression cavity, the compression member and diaphragm may be of any shape, such as an ellipsoid, hyperboloid or paraboloid or a surface derived from a part of the surface of a toroid to match a diaphragm and create a compression cavity. Thus, the shape of the compression cavity may be non-axisymmetric as well.

Figure 4:
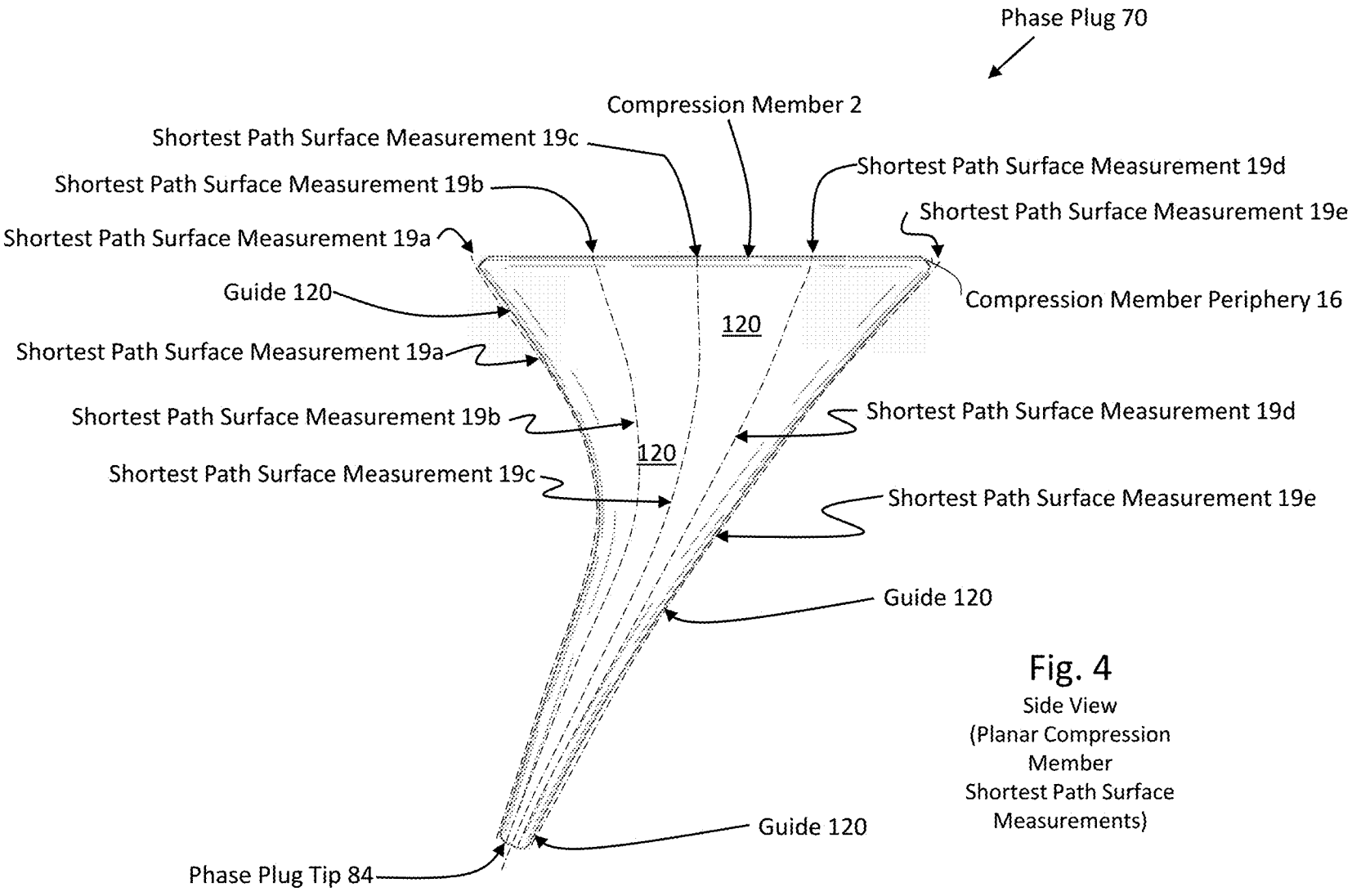
FIG. 4 shows a side view of a phase plug (70) with a planar compression member (2) and shortest path surface measurements (19*a*-19*e*).

One of the primary benefits of the non-axisymmetric phase plugs is that they can fit in a curved space such as in an ear canal. However, for a phase plug to work effectively, the shortest path surface distances from the compression member periphery (16) to the phase plug tip (84) must be substantially the same so that the sound waves achieve phase coherence and not cancel each other out at the phase plug tip (84). FIG. 4 illustrates how this is done with a non-axisymmetric phase plug. On the left-hand side of FIG. 4, it can be seen that the bend in the guide shape creates a shortest path surface measurement 19*a* that is a substantially similar distance as shortest path surface measurement 19*e* on the far-right side of the phase plug without the sharp bend. Similarly, shortest path surface measurements (19*b*, 19*c*, and 19*d*) all have substantially similar shortest path surface distances. This enables the non-axisymmetric phase plug and guides to achieve phase coherence for the sound waves over different paths to the phase plug tip (84).

Figure 5:
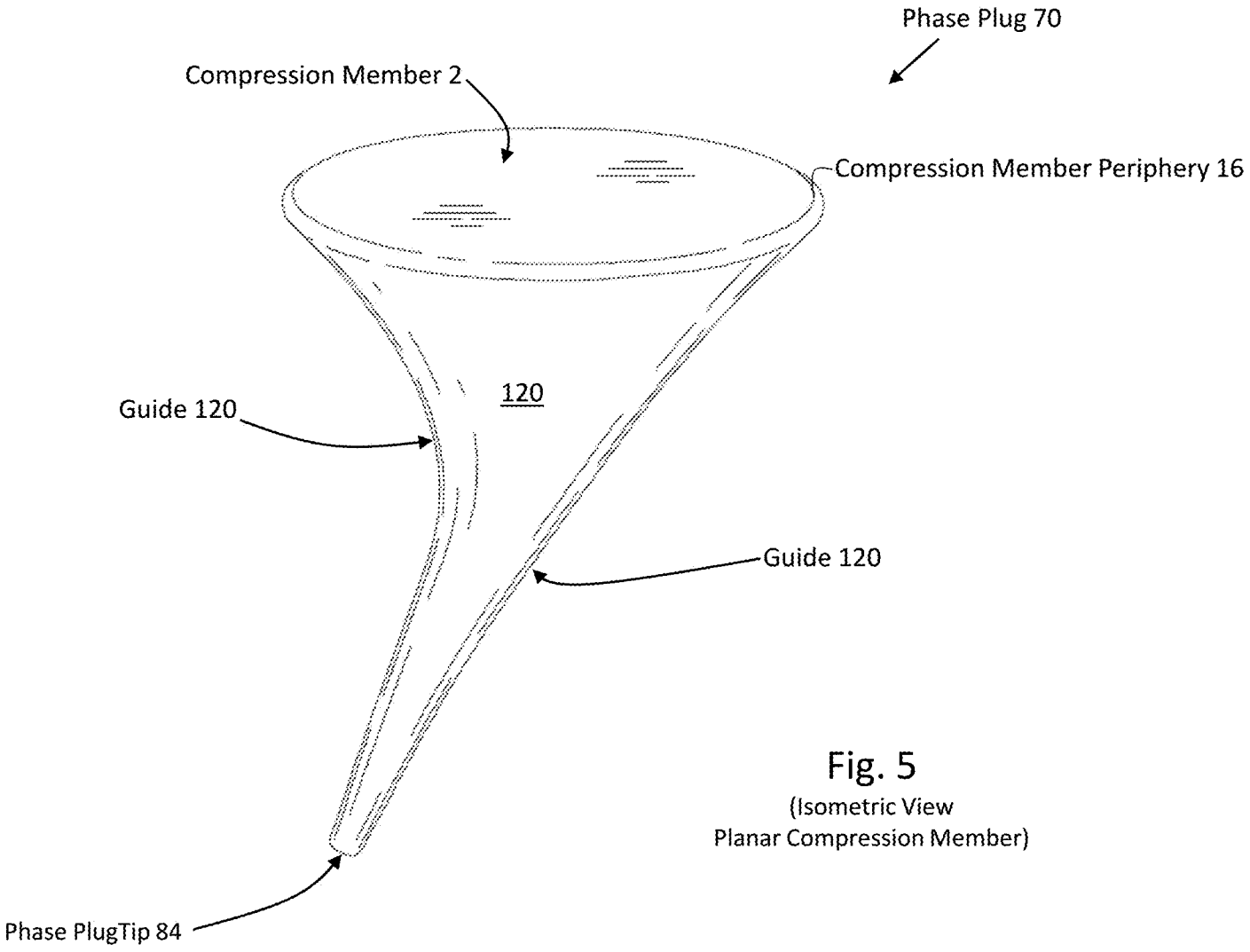
FIG. 5 shows an isometric view of a phase plug (70) with a planar compression member (2).

To give the reader a more three-dimensional perspective on how this works, FIG. 5 shows an isometric view of the non-axisymmetric phase plug using a planar compression member (2).

Figure 6:
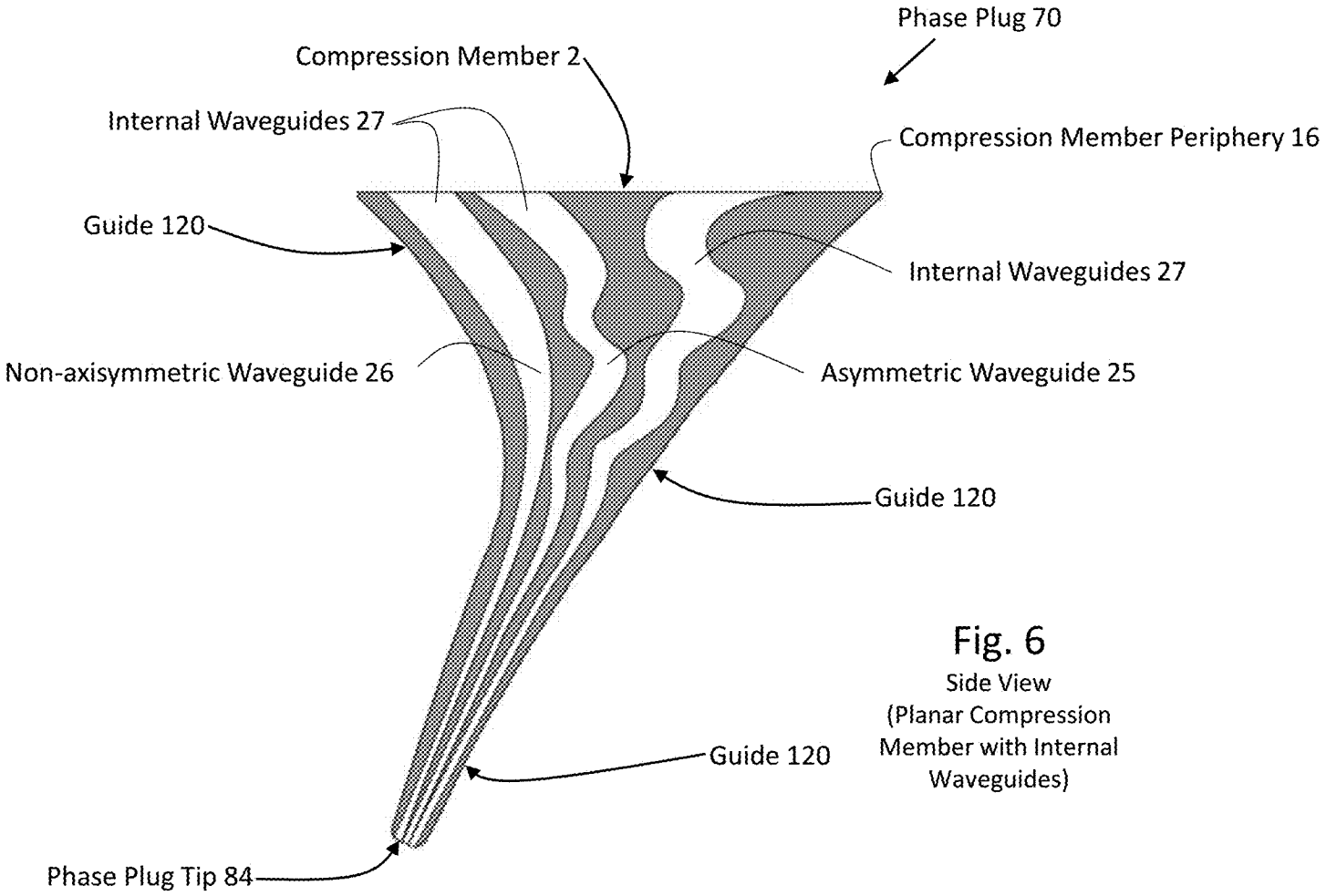
FIG. 6 shows a side view of a phase plug (70) with a planar compression member (2) and internal waveguides (27).

In addition to using the outside guide surface (120) of the axisymmetrical phase plug (70) to achieve substantially similar shortest path surface distances, FIG. 6 illustrates an exemplary use of internal waveguides (27) within the phase plug (70) to achieve similar results. Thus, the phase plug may use the outside guide surfaces (120), the internal waveguides (27), or a combination of these may be used. As long as the shortest path distances are substantially similar, phase coherence can be achieved at the phase plug tip (84).

FIG. 6 illustrates internal waveguides (27) that begin at the compression member (2) and travel through to the phase plug tip (84). However, alternatively, the waveguides (27) may begin at the compression member (2), travel internally through the guide, and exit in the side of the phase plug at the center of the guide or any other location in the guide. The sound waves may then travel external to the guide (120), such that the entire distance from the compression member through the waveguide (27) and out to the guide (120) and then to the phase plug tip (84), so that the entire distance is substantially the same distance as any of the other surface distances. Alternatively, the waveguide (27) may begin at the center of the guide (120), then travel through the phase plug (70), and then emerge from the phase plug (70) out in another place in the guide (120) or out the tip (84), so that the entire distance of the waveguides are substantially the same distance.

The waveguides (27) internal to the phase plug may be tunnels (21) through the phase plug (70), annular rings (22) through the phase plug (70), radial waveguides (23) through the phase plug (70), spirals (24) through the phase plug (70), asymmetric waveguides (25) through the phase plug (70), or non-axisymmetric waveguides (26) through the phase plug (70).

Figure 7B:
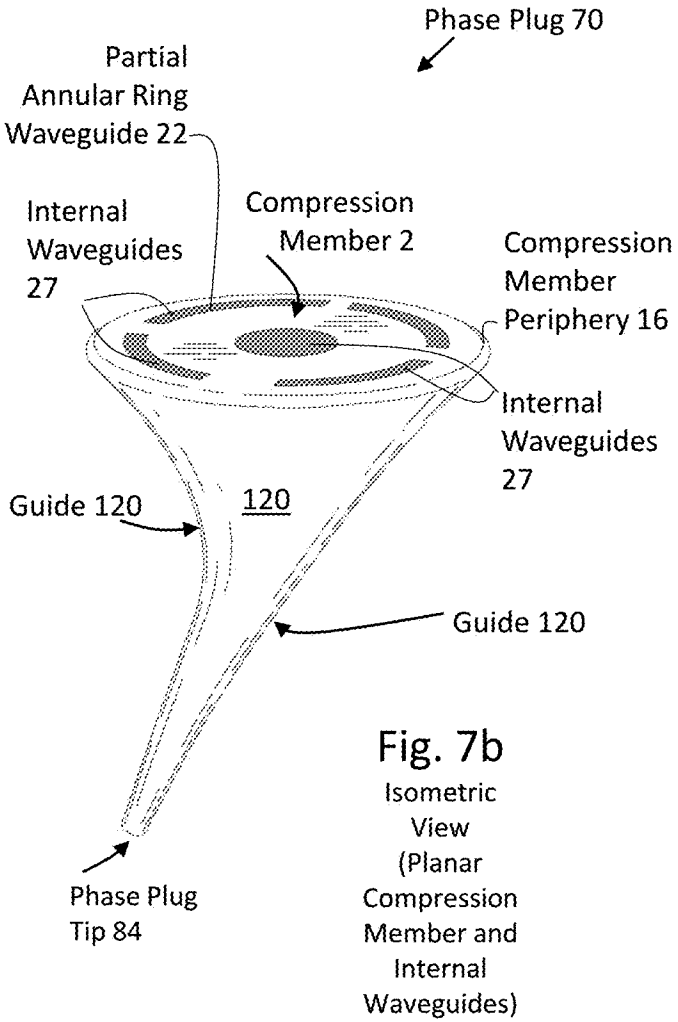
FIGS. 7*a* and 7*b* show an isometric view of a phase plug (70) with planar compression members (2) and internal waveguides (27).
Figure 7A:
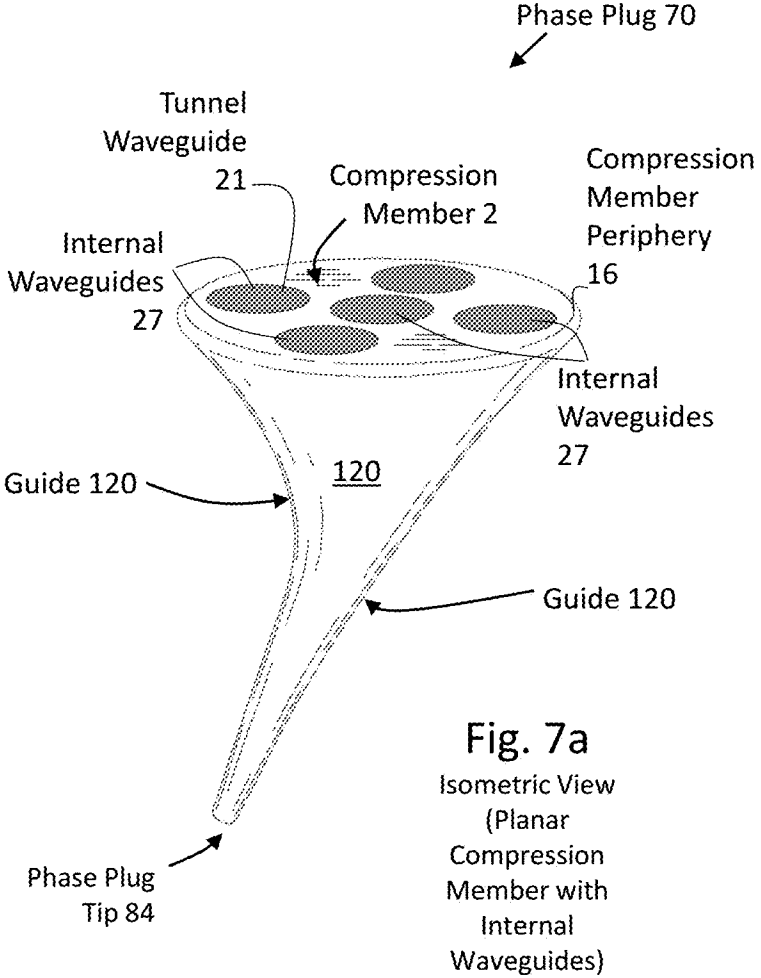

FIGS. 7*a* and 7*b* are illustrative isometric views to give the readers a better three-dimensional perspective on different approaches to using these internal non-axisymmetrical waveguides (27).

Figure 8:
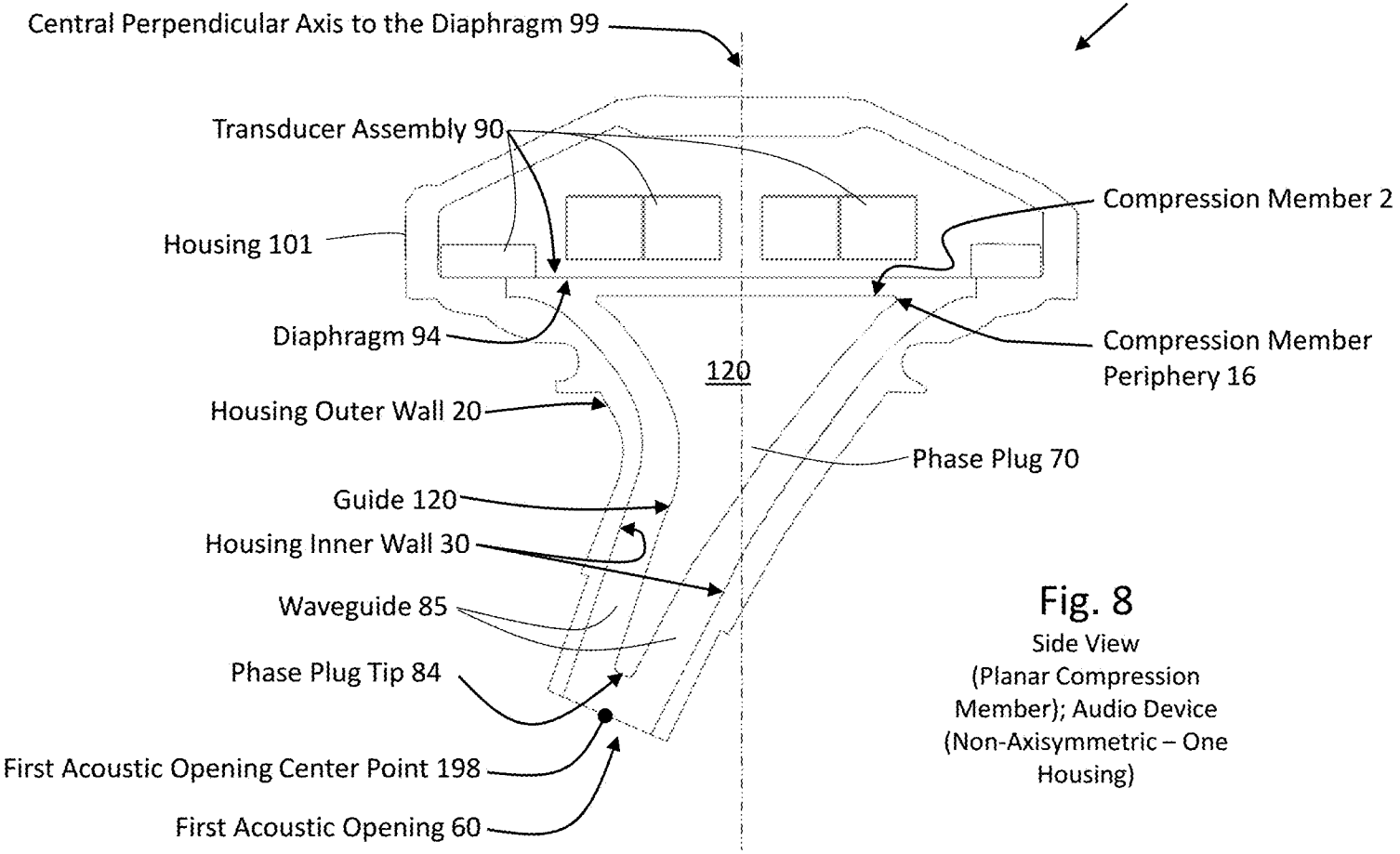
FIG. 8 shows a side view of an audio device (100) with a non-axisymmetric phase plug (70) with a transducer assembly (90) and a planar compression member (2) and waveguides (85).

FIG. 8 provides a cutaway side view of a non-axisymmetrical audio device (100) with a non-axisymmetrical phase plug (70). Here, the audio device (100) comprises a transducer assembly 90, which in this Figure uses a planar magnet transducer. FIG. 8 also illustrates the use of a central perpendicular axis (99) that is established from the center point of the diaphragm (94) as opposed to the compression member center point (93).

FIG. 8 shows a housing (101), with the transducer (90) and the phase plug (70) inside the housing (101). FIG. 8 also illustrates the housing outer wall (20) and the housing inner wall (30). A waveguide (85) is thus formed between the housing inner wall (30) and the guide (120) of the phase plug (70). FIG. 8 also shows the phase plug tip (84) being distal from the transducer assembly (90) and proximate to the first acoustic opening (60). By designing the non-axisymmetric phase plug (70) similar to the housing inner wall (30), waveguides (85) may be formed which have the same waveguide distances from the compression member periphery (16) to the first acoustic opening (60) so that sound wave phase coherence is obtained through the first acoustic opening (60).

FIG. 8 also illustrates that the acoustic housing itself may be non-axisymmetric. This is illustrated by defining a first acoustic opening center point (198), at the center of the first acoustic opening, such that the first acoustic opening center point (198) does not lie on the central perpendicular axis (99).

Figure 9:
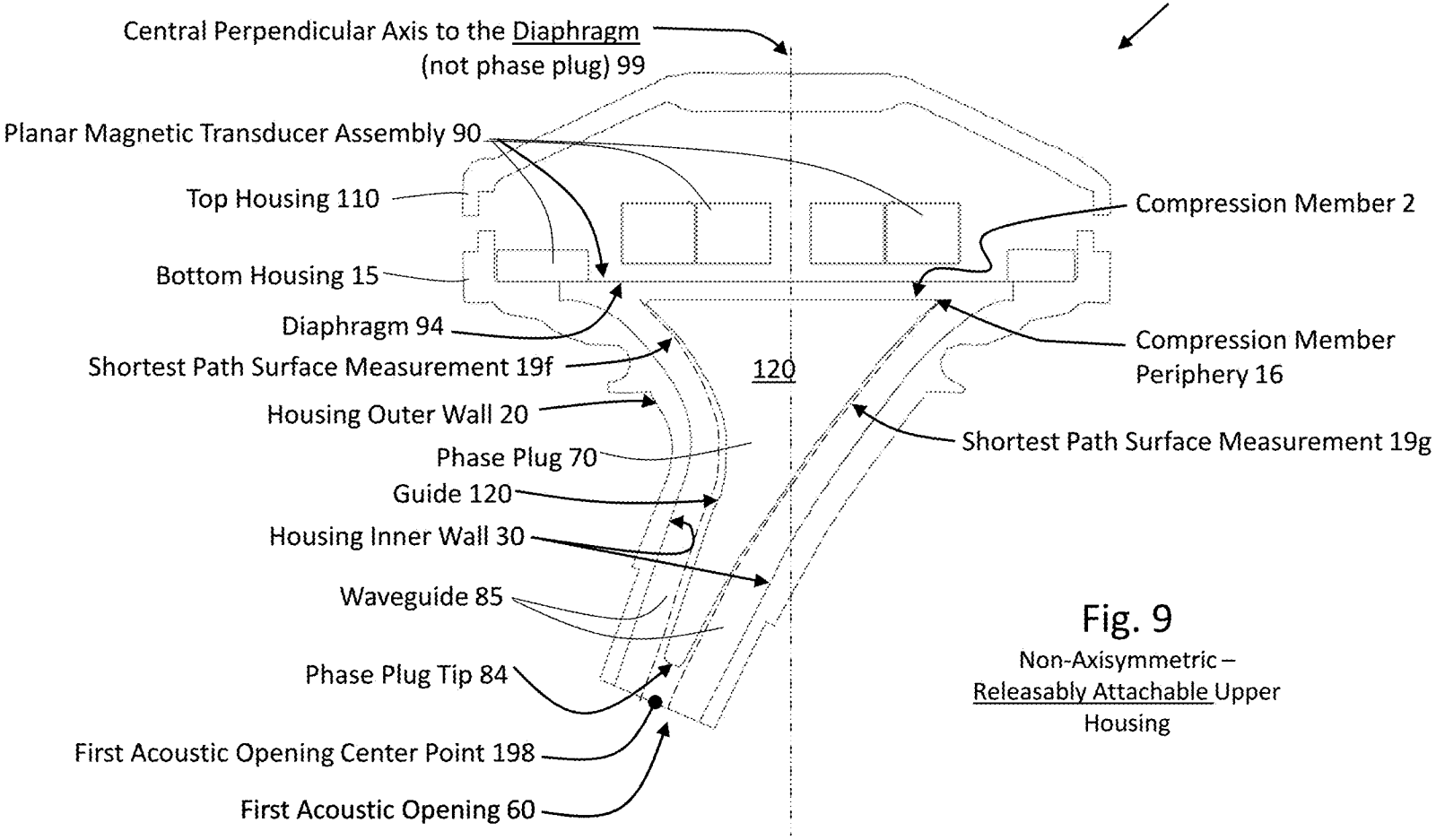
FIG. 9 shows a side view of an audio device (100) with a non-axisymmetric phase plug (70), a planar magnetic transducer assembly (90), a top housing (110) and a bottom housing (15), with an acoustic opening center point (198) and shortest path measurements.

FIG. 9 illustrates that the housing (101) may be separated into a top housing (110) and a bottom housing (15). In this example, the top housing (110) may be releasably attachable to the bottom housing (15) such that the transducers (90) may be changed, or bottom housings (15) may be swapped out, such that different size housings, different phase plugs, and other different configurations may be obtained.

FIG. 9 also shows that the shortest path surface measurement 19*f* on the left-hand side of the phase plug (70) in FIG. 9 may be substantially similar in distance to the shortest path surface measurement 19*g* on the right-hand side of the phase plug (70). This further demonstrates the capability of achieving strong phase coherence in a non-axisymmetric acoustical housing.

Figure 10:
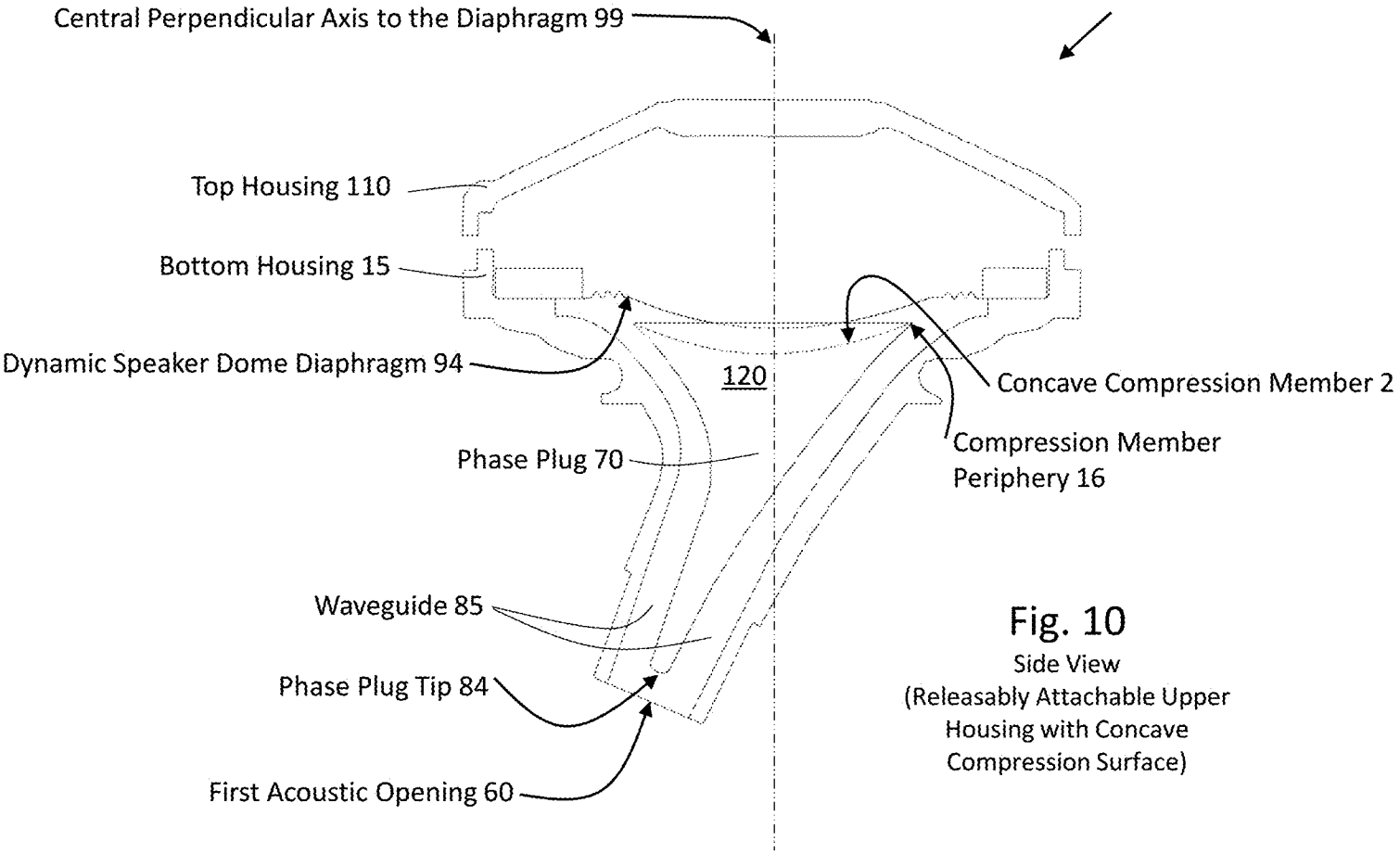
FIG. 10 shows a side view of an audio device (100) with a non-axisymmetric phase plug (70) and a concave compression member (2).

FIG. 10 shows a side view of audio device (100) with the releasably attachable top housing (110), but in this case, the housing comprises a concave compression member (2) in conformance with a dynamic speaker dome diaphragm (94).

Figure 11:
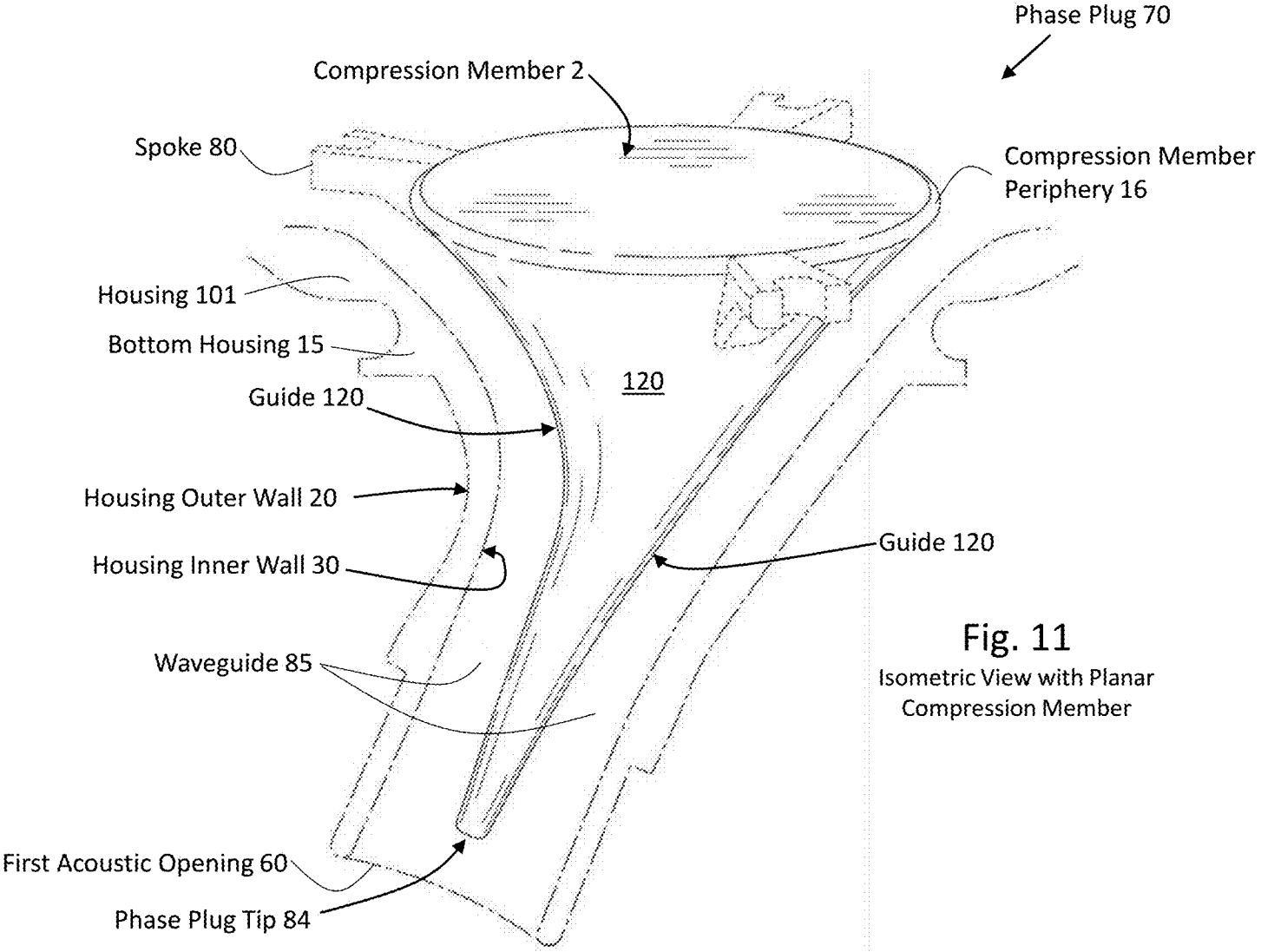
FIG. 11 shows an isometric view of a non-axisymmetric planar phase plug (70) mounted in a housing (101).

To give the reader a three-dimensional visualization of the phase plug (70), FIG. 11 shows an isometric view of the acoustical housing (101) with the non-axisymmetric phase plug (70) installed and supported by spokes (80) to secure the phase plug (70) into place.

Figure 12:
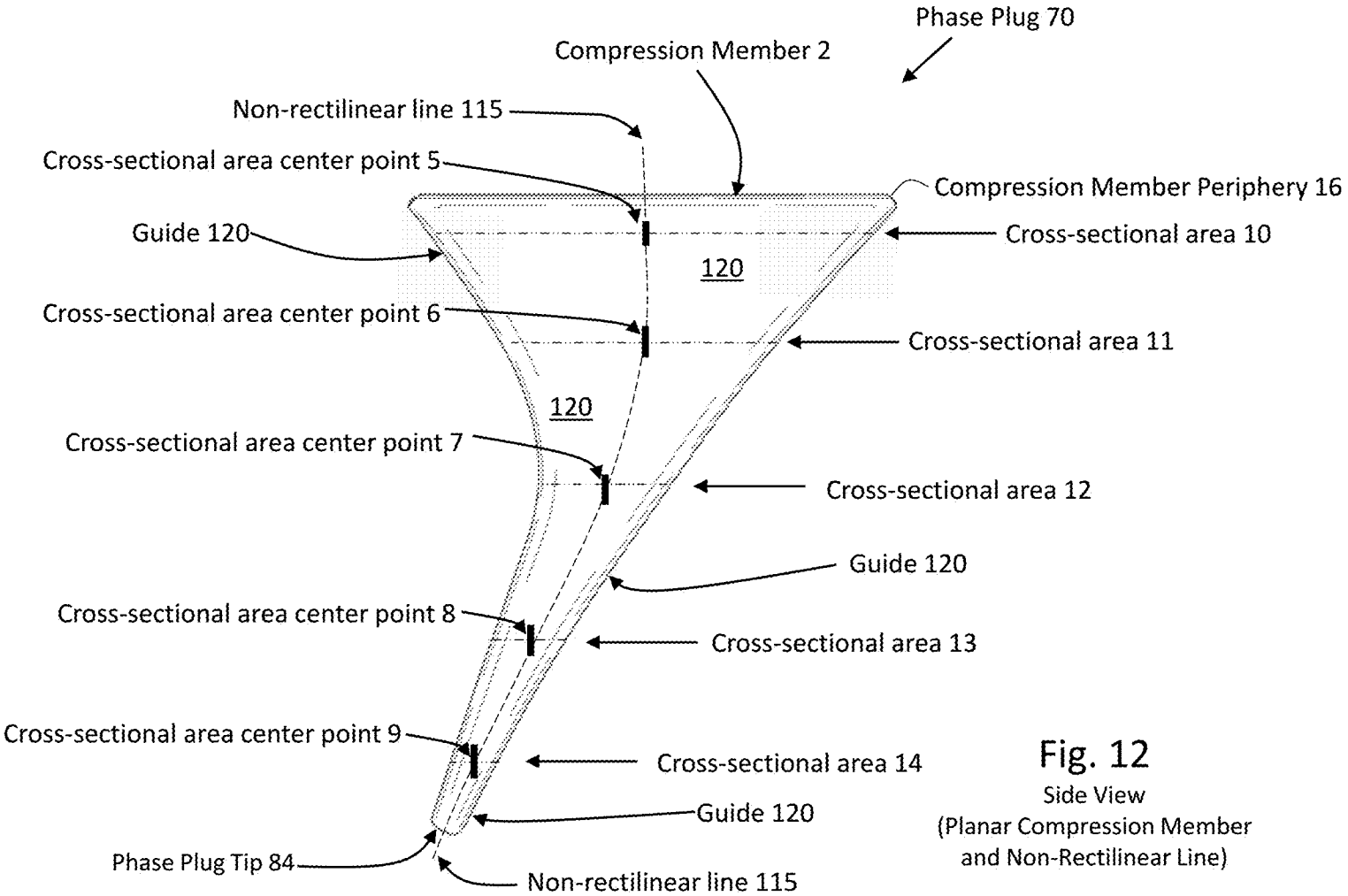
FIG. 12 shows a side view of a phase plug (70) with a planar compression member (2) with cross-sectional area center points defining a non-rectilinear line (115).

FIG. 12 shows an alternative view of defining a non-axisymmetric phase plug (70), wherein compression member (2) is operatively configured with a transducer diaphragm, such that compression member (2) has a periphery (16); and the guide (120) extends from the compression member periphery (16) to a phase plug tip (84). In this example, the guide (120) has a plurality of cross-sectional areas (10-14) defined substantially parallel to the compression member periphery (16). Each cross-sectional area (10-14) has a center point (5-9) such that a successive tracing of the cross-sectional area center points (5-9) from the compression member (2) to the tip (84) defines a non-rectilinear line (115).

Figure 13:
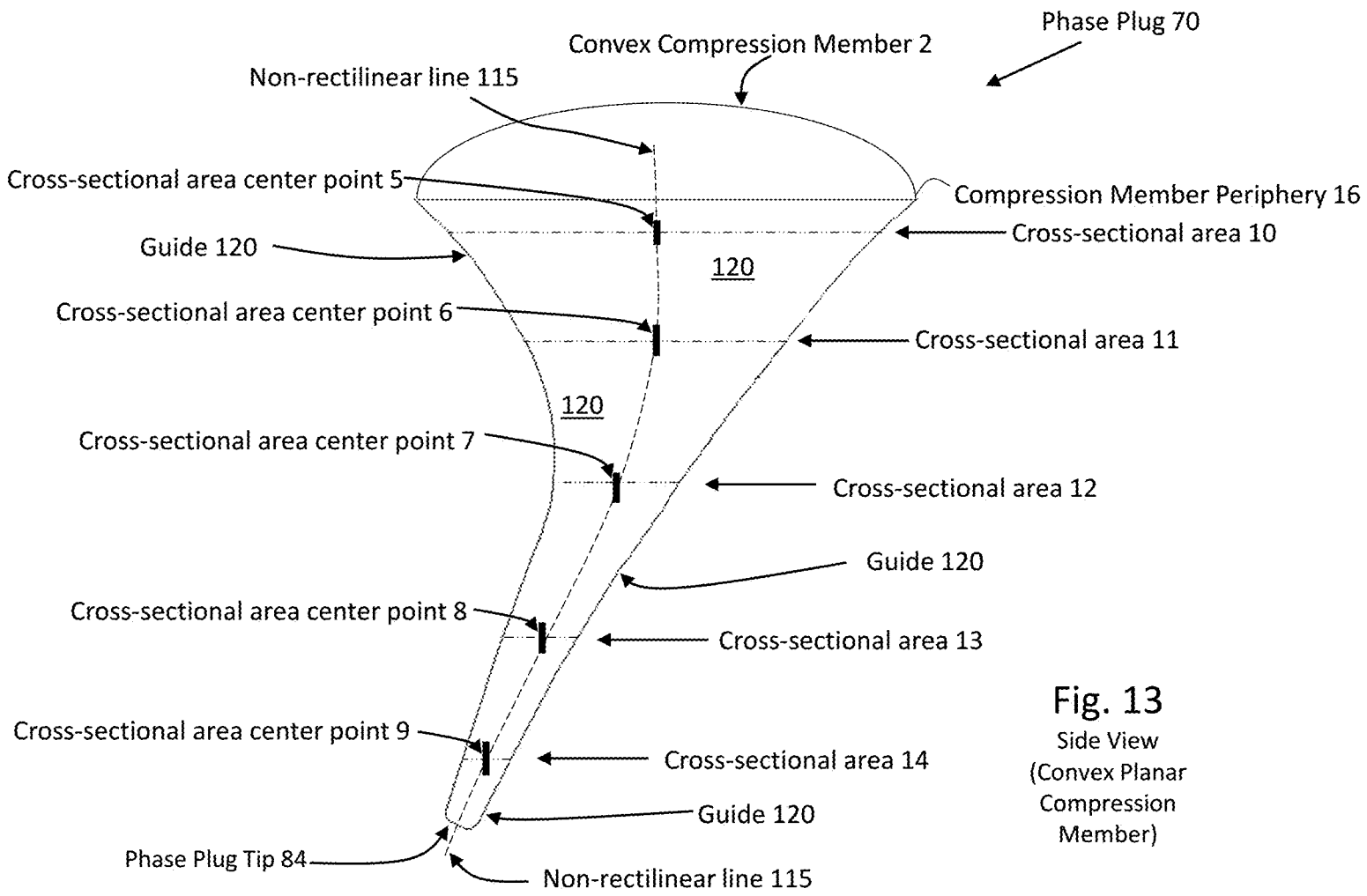
FIG. 13 shows a side view of a phase plug (70) with a convex compression member (2) with cross-sectional area center points defining a non-rectilinear line (115).
Figure 14:
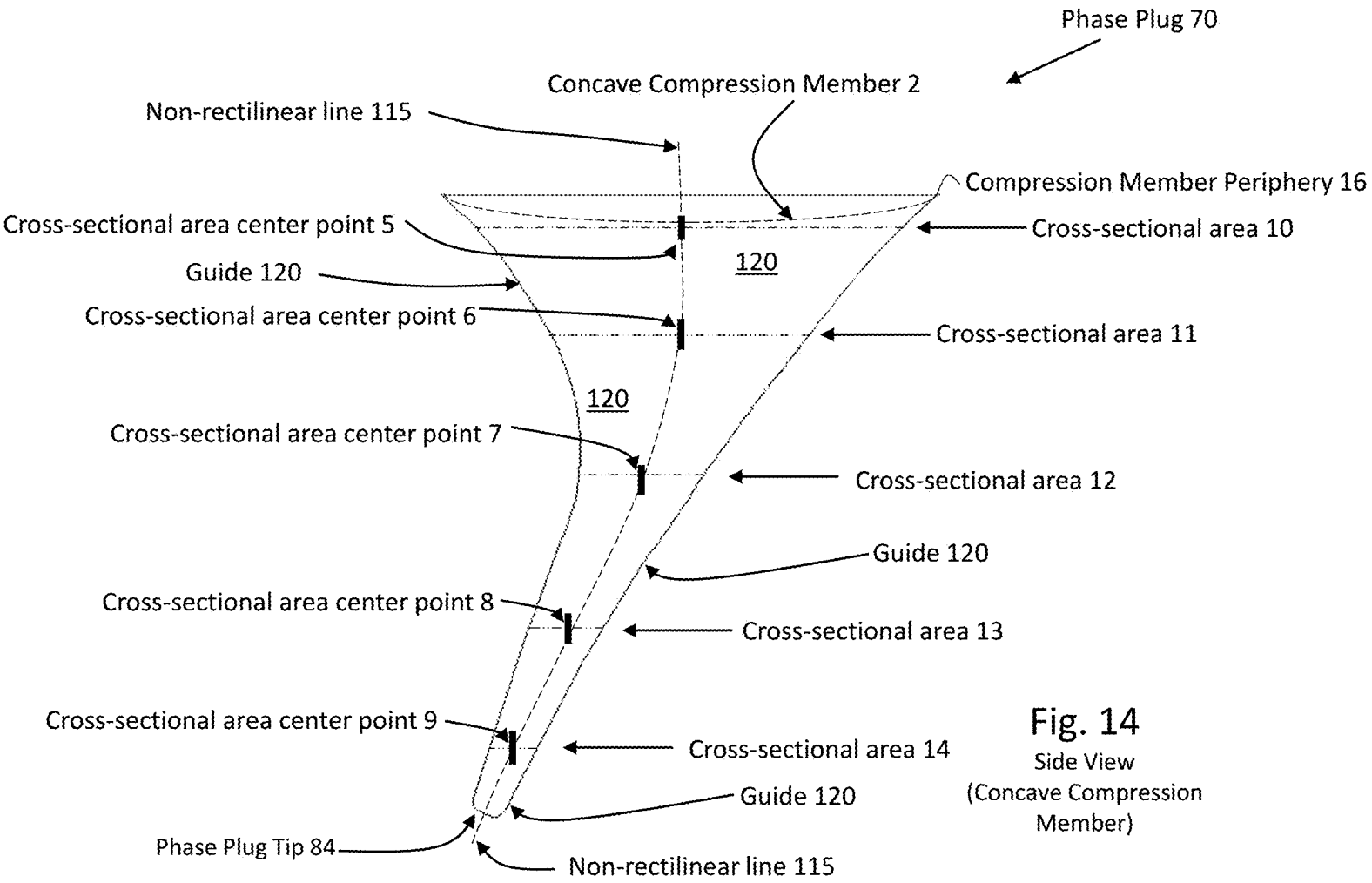
FIG. 14 shows a side view of a phase plug (70) with a concave compression member (2) with cross-sectional area center points defining a non-rectilinear line (115).
Figure 15:
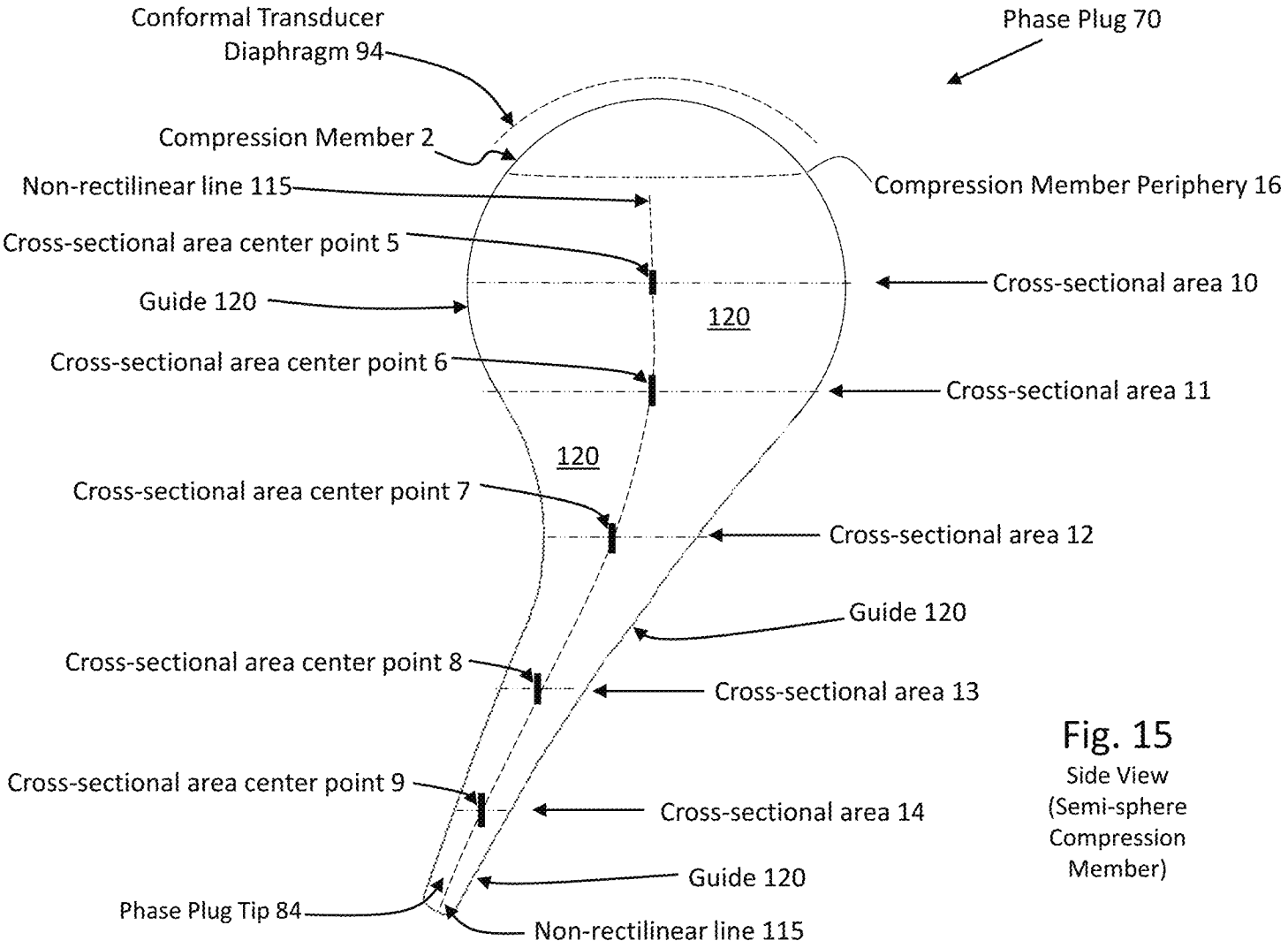
FIG. 15 shows a side view of a phase plug (70) with a semi-sphere compression member (2) with cross-sectional area center points defining a non-rectilinear line (115).

FIG. 13 shows a similar defining of a non-axisymmetric phase plug using the non-rectilinear line approach, but with a convex compression member (2). FIG. 14 illustrates the same principle with a concave compression member (2). FIG. 15 illustrates the capability of using a semi-spherical compression member (2) conformal to a semi-spherical transducer diaphragm (94). Here, the compression member periphery (16) is defined in relation to the conformal transducer diaphragm (94).

Figure 16:
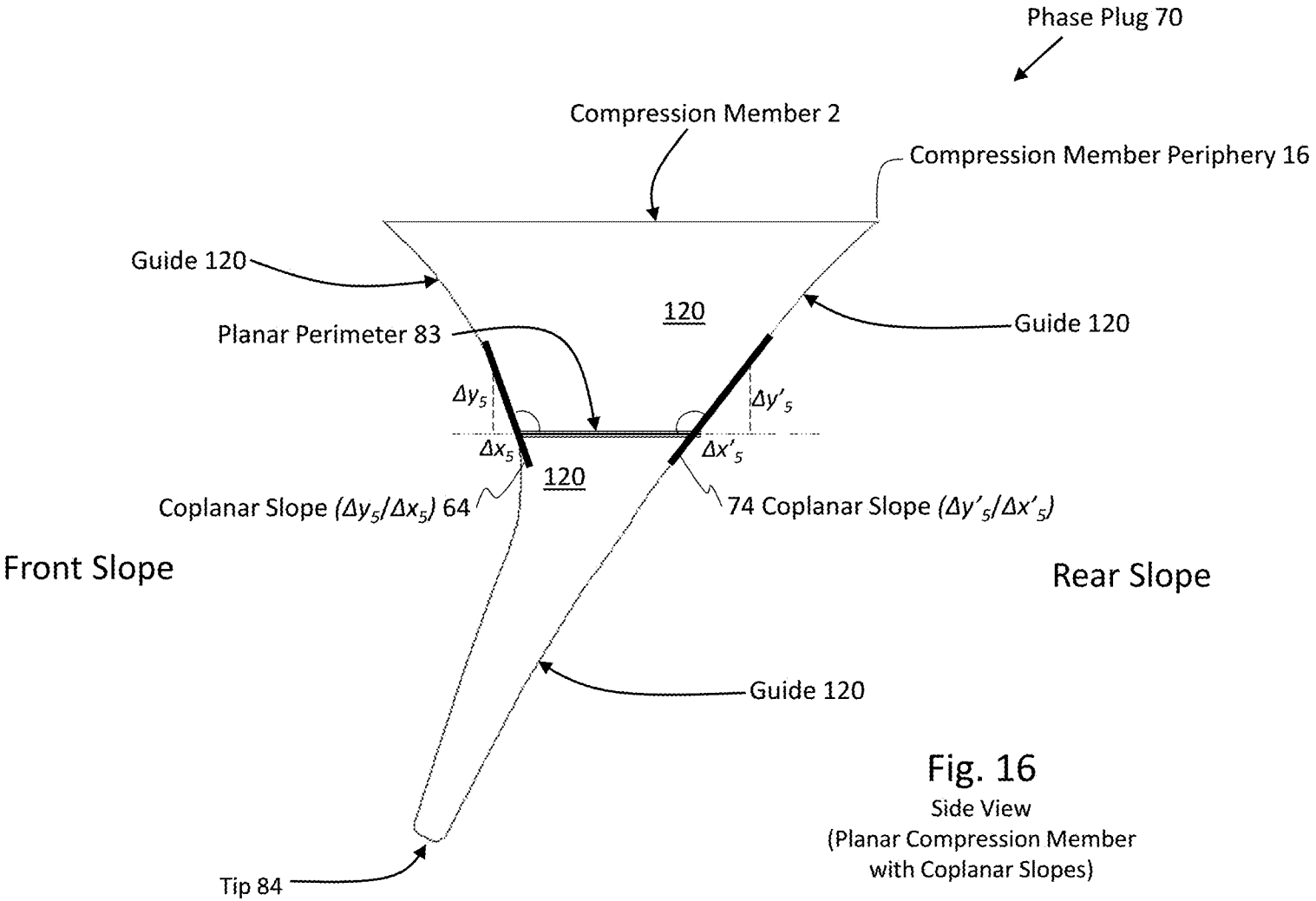
FIG. 16 shows a side view of a phase plug (70) with a planar compression member (2) with unequal coplanar slopes around a planar perimeter (83).

FIG. 16 shows a side view of phase plug (70) with a planar compression member (2). Here, the phase plug (70) defines a planar perimeter (83) around the guide (120) substantially parallel to the compression member periphery (16), such that coplanar slopes (64, 74) of the perimeter (83) around the guide are unequal slopes.

Figure 17:
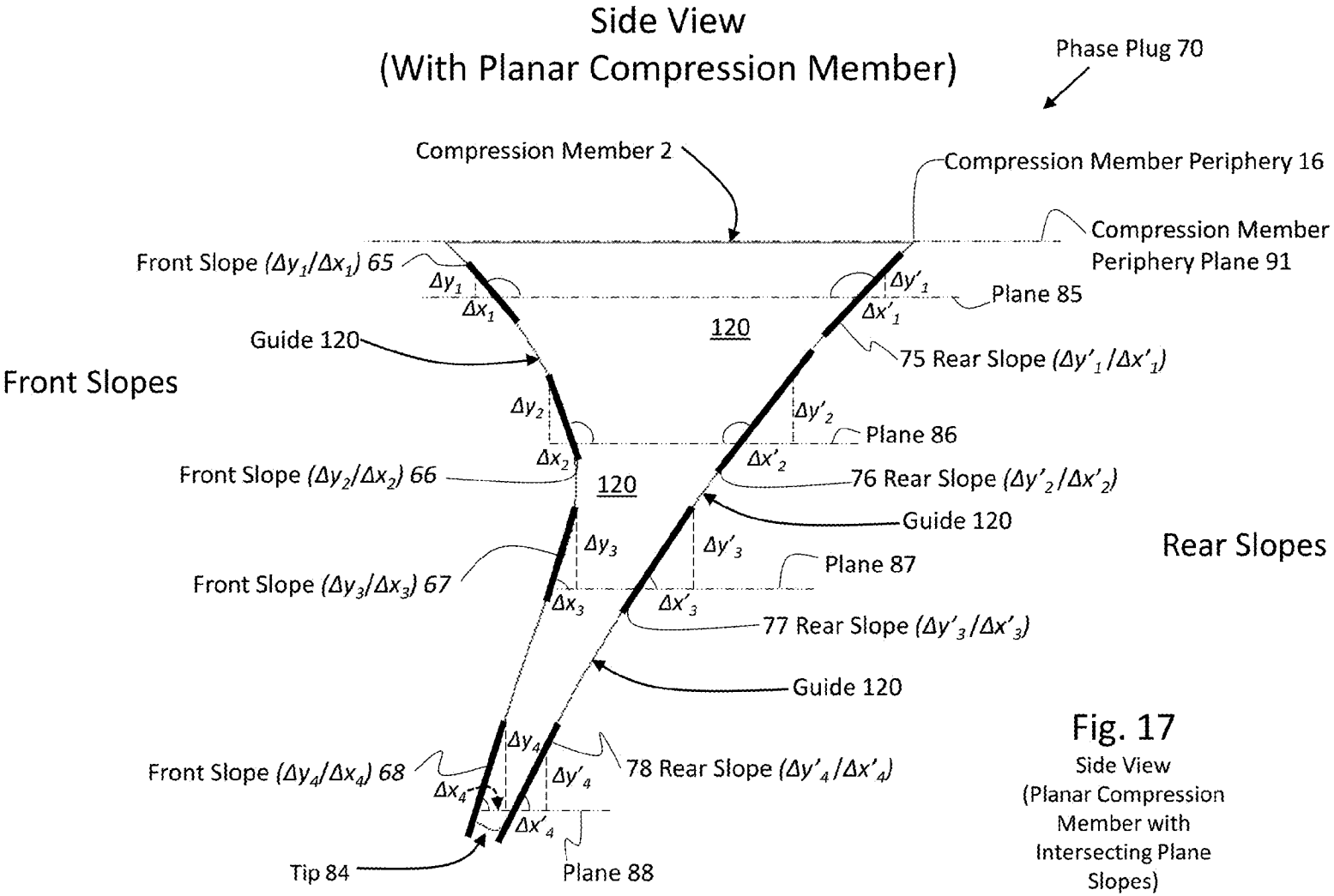
FIG. 17 shows a side view of a phase plug (70) with a planar compression member (2) with planes (85, 86, 87, 88) intersecting the guide (120) parallel to the compression member periphery where front slopes are unequal to rear slopes.

FIG. 17 shows a side view of phase plug (70) wherein the compression member periphery (16) defines a compression member periphery plane (91), such that when planes (85, 86, 87, 88) are in parallel with the compression member periphery plane, they intersect the guide (120), such that at least one front slope (65, 66, 67, 68) of guide (120) at planes (85, 86, 87, 88) is unequal to its opposite side rear slope (75, 76, 77, 78) of guide (120).

Figure 18:
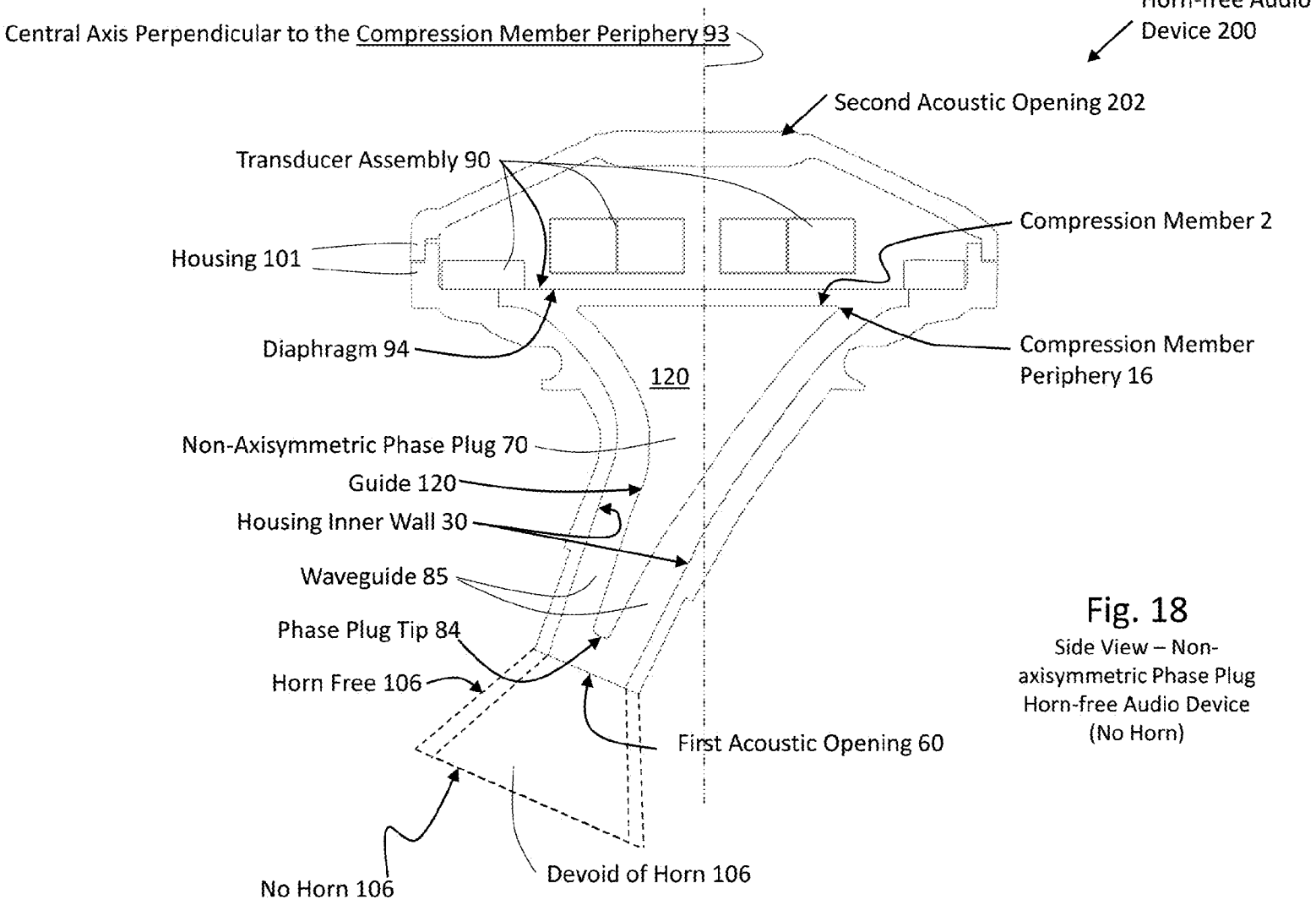
FIG. 18 shows a side view of a non-axisymmetric horn-free audio device (200).

FIG. 18 shows a horn-free audio device (200) as an aspect, where a housing (101) has a first acoustic opening (60); a transducer assembly (90) is disposed on the housing (101), such that the transducer assembly (90) is located distal to the first acoustic opening (60); and phase plug (70) is disposed within the housing (101) between the transducer assembly (90) and the first acoustic opening (60), such that the acoustic opening (60) is free of a horn (106). Traditionally, phase plugs guide compressed sound waves into a horn. Here, novelty and unobviousness is established by the fact that this device uses no horn at all. When viewed as an earphone, the converged coherence of the sound waves at the first acoustic opening (60) can be fed directly into the ear without the need for the industry-standard horn.

Thus, the dashed lines in FIG. 18 are used to indicate that there is no traditional horn involved. The first acoustic opening (60) emits the compressed coherent sound waves past the phase plug, and out the first acoustic opening directly into the ear.

In another aspect, FIG. 18 illustrates that the housing (101) may also comprise a second acoustic opening (202). This second acoustic opening may be used to establish that the housing is open or semi-closed.

Figure 19:
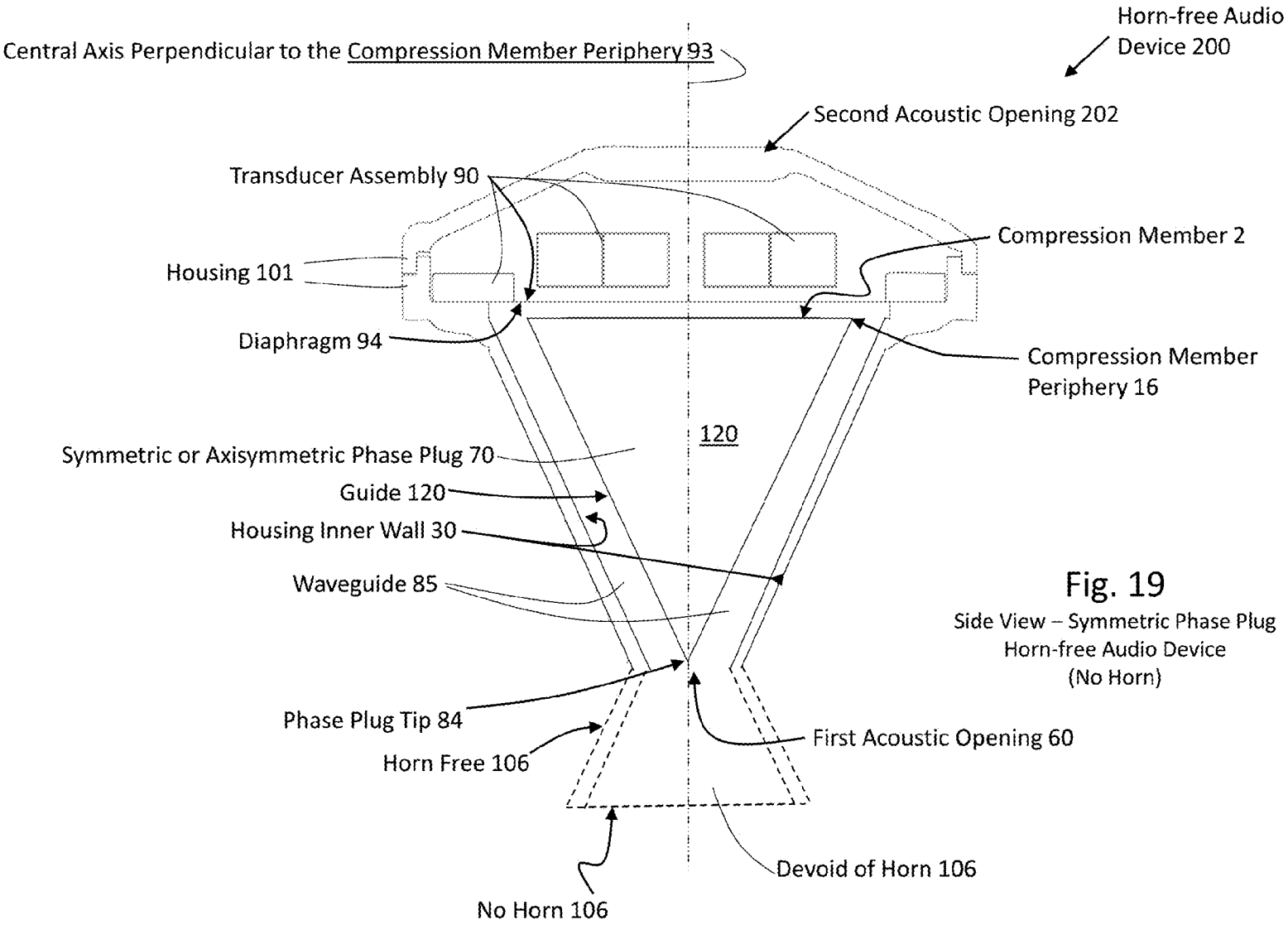
FIG. 19 shows a side view of a symmetric horn-free audio device (200).

FIG. 19 illustrates this same novel approach of not using a horn (horn avoidance) for a symmetrical phase plug as well as with a non-axisymmetrical phase plug. Here, the diaphragm compresses the air at audio frequencies against the compression member (2). The vibrating air is then passed through the waveguides (85) so that the sound wave coheres at the exit point but directly into the ear without any semblance of a horn or other decompression or expansion action.

FIG. 19 also illustrates that the housing (101) may also comprise a second acoustic opening (202). This second acoustic opening may be used to establish that the housing is open or semi-closed.

Figure 20:
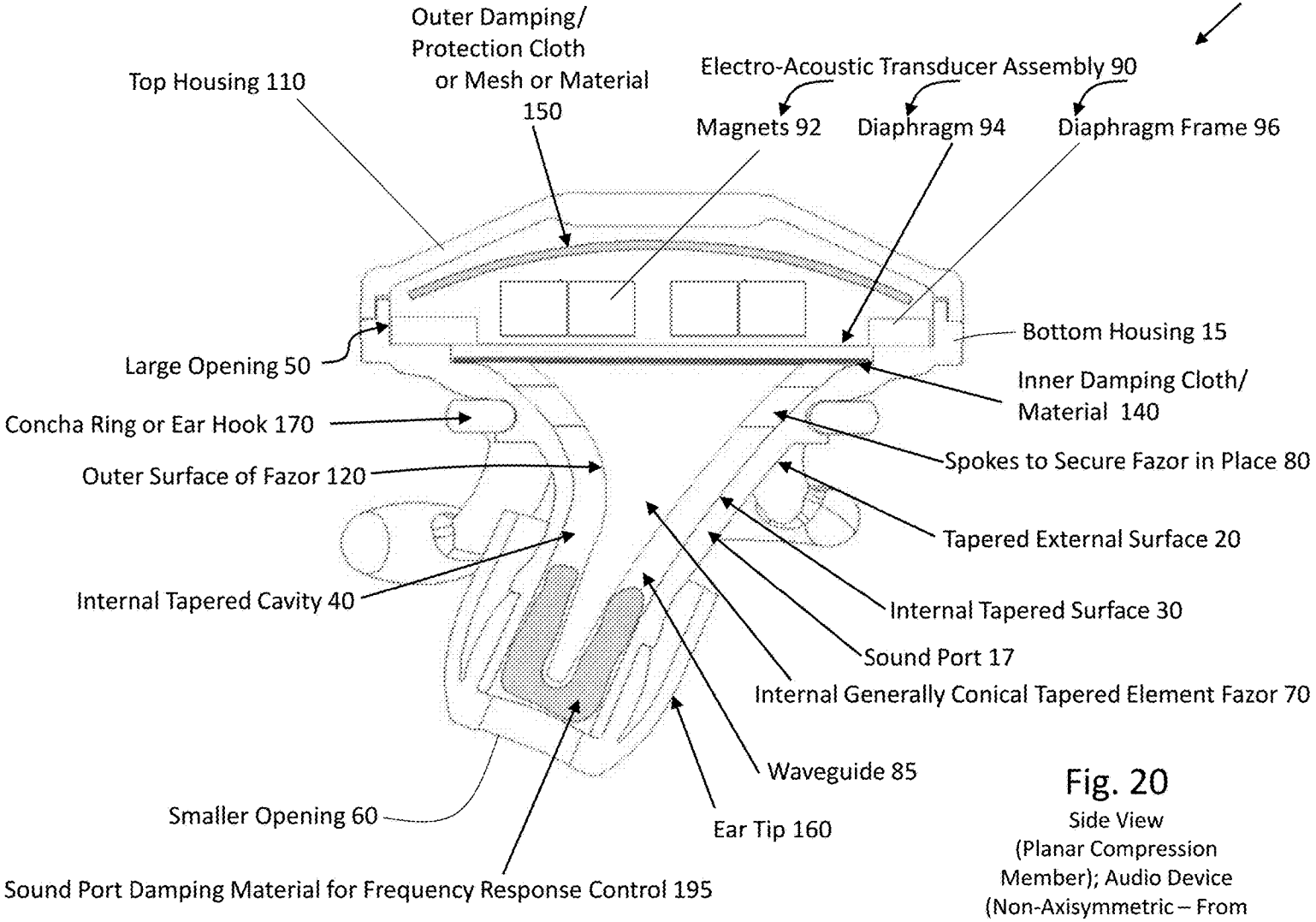
FIG. 20 shows a detailed cutaway view of the in-ear audio device (105).

FIG. 20 is a cross-sectional view of one aspect of invention, an illustrative in-ear audio device (105). The device (105) comprises an illustrative tapered hollow sound port (17), an illustrative internal generally-conical tapered element (70) (also described as a phase shifting element, phase-shift plug, or Fazor™) which is suspended within the tapered hollow sound port, and an illustrative electro-acoustic transducer assembly (90) mounted around the rim of the large opening (50) of the tapered hollow sound port.

The tapered external surface (20) or housing outer wall (20) of the tapered hollow sound port may be formed to fit within an ear canal. The standard ear canal sound ports (10) may be standard universal-style housings which fit many people, or they may be individually molded to fit individual ears by using methods to form or mold individual ear shapes to fit individual people, as is common in the industry. The internal tapered surface (30) or housing inner wall (30) of the sound port is formed to affect the acoustical properties such as phasing and phase-shifting, decreased sound diffraction, improved acoustic loading, improved reflection characteristics, and decreased sound distortion. By varying the size and shape of the Internal Tapered Cavity (40) or waveguide (85), various acoustical adjustments may be made.

FIG. 20 also shows the internal generally-conical tapered element (70) (also described as a phase shifting element, phase-shift plug, or Fazor™), which may be inserted into or molded on the sound port (17). The internal generally-conical tapered element (70) may be formed in various shapes to affect the acoustical properties of the device. These acoustical properties also may comprise phasing and phase-shifting, decreased sound diffraction, improved acoustic loading, improved reflection characteristics, and decreased sound distortion. By varying the shape and placement of the phase-shifting element (70) within the Internal Tapered Cavity (40) or waveguide (85) in the sound port (17) the change in shape of the at least one waveguides (85) between the phase-shifting element (70) and the internal tapered surface (30) or housing inner wall (30) will enable finely controllable acoustic properties such as phase-shifting, decreased sound diffraction, improved acoustic loading, improved reflection characteristics, and decreased sound distortion.

The internal generally-conical tapered element (70) is not limited to a single instance, as there may be multiple internal generally-conical tapered elements (70) within the Internal Tapered Cavity (40) or waveguide (85) (not shown). The internal generally-conical tapered element (70) is also not limited to being in the center of the Internal Tapered Cavity (40) or waveguide (85). Although the internal generally-conical tapered element (70) may be attached to the sound port (17) with one or more spokes (80), the internal generally-conical tapered element (70) may also be attached directly to the internal tapered surface (30) or housing inner wall (30) to adjust the acoustical properties in the Internal Tapered Cavity (40) or waveguide (85).

The outer surface (120) of the Fazor™ (70) or guide (120) is generally smooth in its tapering. However, the outer surface (120) of the Fazor™ (70) or guide (120) is not necessarily completely parallel to the internal tapered surface (30) or housing inner wall (30). In other words, the waveguides (85) may or may not be the same width in all locations. The waveguides may be parallel, inward-sloping, or outward-sloping as they travel from the large opening (50) to the smaller opening (60).

FIG. 20 also shows the illustrative electro-acoustic transducer assembly (90) comprising illustrative magnets (92), one or more diaphragms (94), and one or more diaphragm frames (96). The electro-acoustic transducer assembly (90) may be any type of various electro-acoustic transducer assemblies (90), including dynamic transducers, planar transducers, planar magnetic transducers, cone voice coil transducers, dome voice coil transducers, electrostatic transducers, piezo electric transducers, or any other kind of transducer. Further, this electro-acoustic transducer assembly (90) may optionally be sealed or not sealed to the rim of the bottom housing (15).

FIG. 20 also shows an optional illustrative top housing (110) mounted on the top rim of the large opening (50) in the tapered hollow sound port (17). This top housing 110 is optional, but if it is used, it may be closed, open, or semi-closed (not shown) as desired to affect the audio characteristics of the device (105).

FIG. 20 also shows an optional illustrative outer damping material (150) placed above the electro-acoustic transducer assembly (90). This outer damping material (150) may be made of cloth, foam, mesh, or other material for the purposes of damping acoustic signals and/or protection of the electro-acoustic transducer assembly (90).

FIG. 20 also shows an optional illustrative inner damping material (140) placed below the electro-acoustic transducer assembly (90). This inner damping material (140) may be made of cloth, foam, mesh, or other material for the purposes of damping acoustic signals.

FIG. 20 also shows an illustrative optional ear tip (160) positioned around the small hole (60) in the tapered hollow sound port (17). This ear tip (160) may be made of a soft material such as silicone, rubber, foam, or any other material that would be comfortable in the ear and provide sound isolation.

FIG. 20 also shows an illustrative optional sound port damping material (195) which may be used inside of the sound port (17) above the smaller opening (60). This sound port damping material (195) may be made of any acoustical material, and is generally used for controlling the frequency response.

FIG. 20 also includes an illustrative optional concha ring or ear hook (170) for support and stability of the device. This concha ring or ear hook (170) may be affixed to the device or it may be detachable, such that the wearer or user may take the ear hook (170) off or put it on as desired. Further the concha ring or ear hook (170) may be made of any desired material in any desirable shape or style.

Figures 21A, 21B, 21C, 21D:
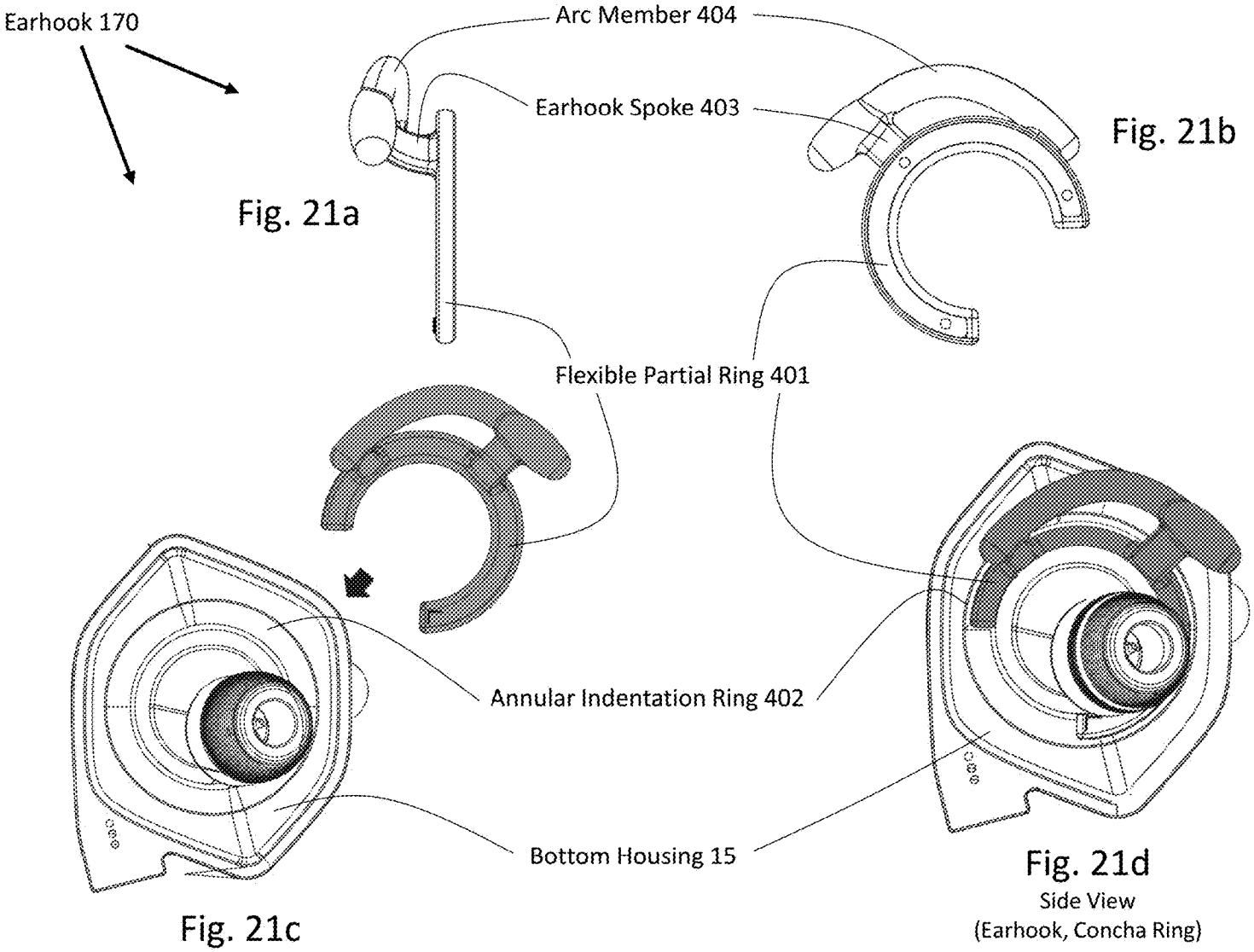
FIGS. 21*a*-21*d* show the detachable earhook (170).
Figure 22A:
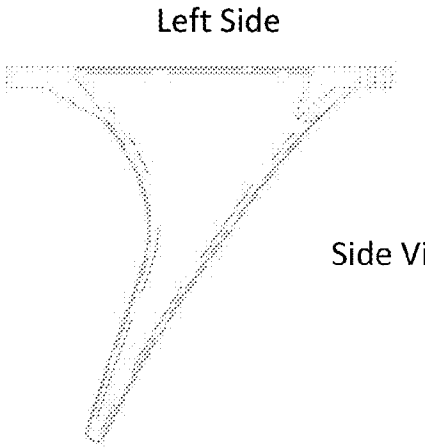
FIGS. 22*a*-22*f* show plan views of the non-axisymmetric phase plug.
Figure 22B:
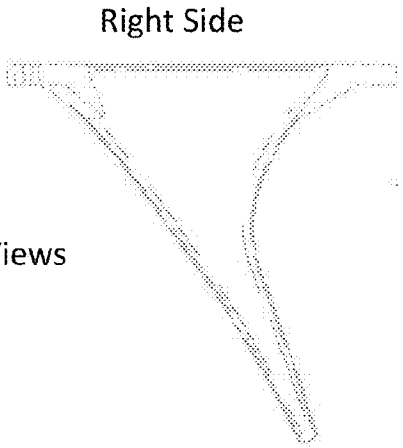
Figure 22C:
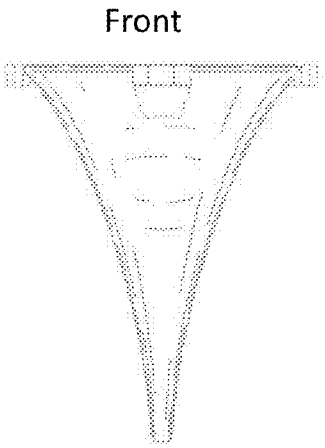
Figure 22D:
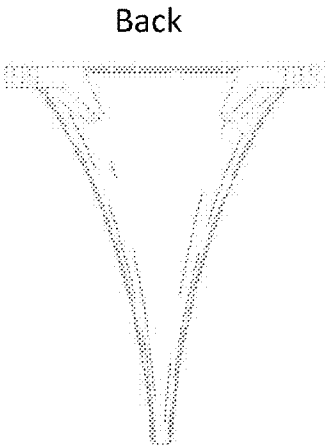
Figure 22E:
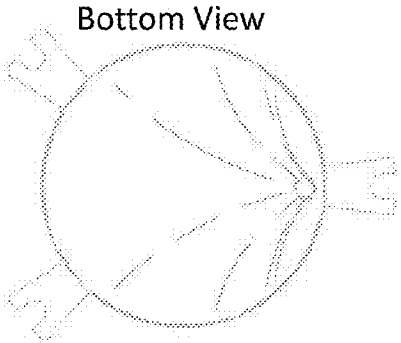
Figure 22F:
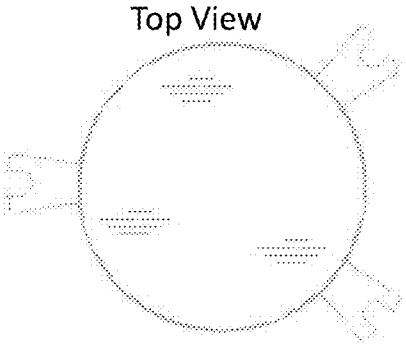

FIG. 21 shows various aspects with an earhook (170) including concha rings to support the earphones in the ear. The earhook (170) comprises: a flexible partial ring (401) that is releasably attachable to an annular indentation ring (402) on the bottom housing (15). The earhook also comprises an earhook spoke (403) having two ends, such that the first end of the spoke (403) is attached to the flexible partial ring (401). The concave section of an arc member (404) is disposed on the second end of the spoke (403), such that the arc member (404) fits into and adheres to a human ear concha.

To clearly establish the shape and design of the phase plug (70), FIG. 22*a*-FIG. 22*f* establishes the perspective views of the planar compression member phase plug. Here, left side, right side, front, back, bottom view and top view are established, including dashed lines for the spokes (80) to secure Fazor™ (phase plug (70)) in place.

Figure 23A:
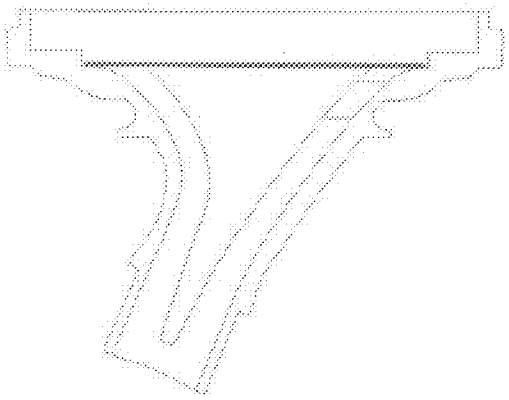
FIG. 23*a*-23*f* show various configurations of the housing and phase plug or Fazor™, including.

In FIG. 23, various aspects of the Fazor™ (Phase Plug (70)) are described in FIGS. 23*a*-23*f*. Turning now to FIG. 23*a*, we see the Fazor™ (70) integrated with the bottom housing (15). In FIG. 23*a*, the Fazor™ may be secured with one or more spokes (80). Cross sections of these spokes are generally shaped to be aerodynamic such that the top edges are rounded, and the bottom edges are smoothly tapered so as to minimize reflections, diffractions, interference, and other air turbulence. These spokes (80) should be as small as possible, but they can expand through the whole length of the Fazor™ (70).

Figure 23B:
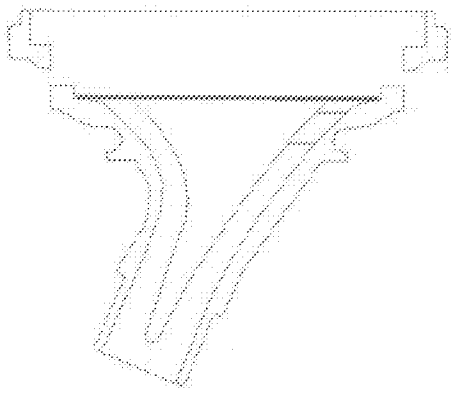

FIG. 23*b* illustrates an embodiment where the Fazor™ (70) and the sound port (17) are detachable from the bottom housing (15). This solution allows different shapes and sizes of sound ports (10) to be installed on the same earphones. The sound port can also be molded to an ear canal impression of the user for the best possible fit. In this case ear tips (160) may be avoided since the sound port may be already molded to accurately fit the ear canal. In this embodiment, making the electro-acoustic transducer assembly (90) removable from the bottom housing (15) makes it replaceable by a different electro-acoustic transducer assembly. Further, making the top housing (110) removable from the bottom housing (15), makes the bottom housing (15) replaceable with a different top housing (110). Alternatively, by making the top housing (110) and the electro-acoustic transducer assembly (90) as a single unit, the entire unit is removable and replaceable by a different top housing and transducer assembly.

Figure 23C:
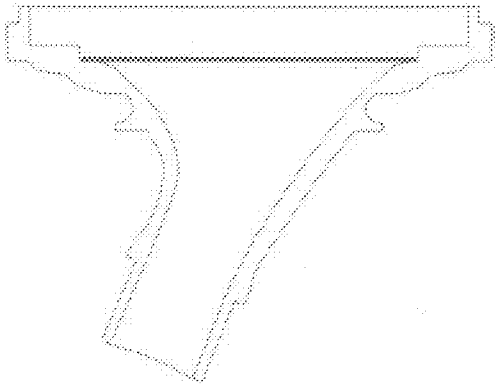

FIG. 23*c* illustrates the sound port (17) without the Fazor™ (70).

Figure 23D:
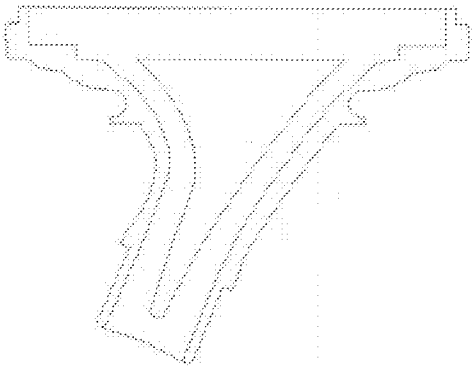

FIG. 23*d* shows the outer surface (120) of the Fazor™ (70) or guide (120) and the inner surface (30) of the sound port essentially in parallel. Here the waveguide (85) shape has an important role in acoustic impedance matching. Proper design provides better efficiency, smoother frequency response, better high frequency extension, and smoother phase response.

Figure 23E:
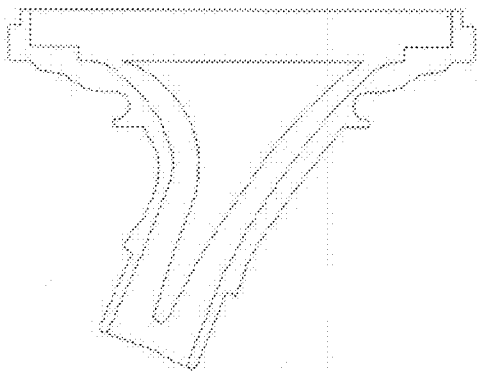

FIG. 23*e* shows the outer surface (120) of the Fazor™ (70) or guide (120) and the inner surface (30) of the sound port generally expanding as the waveguide (85) gets closer to the smaller opening (60).

Figure 23F:
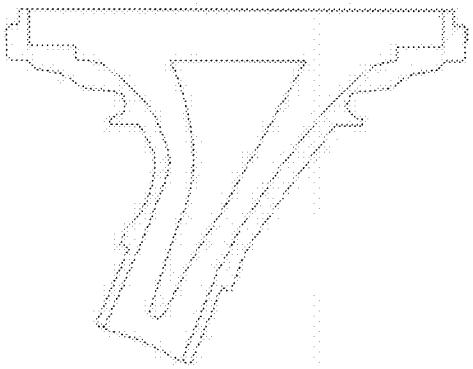

FIG. 23*f* shows the outer surface (120) of the Fazor™ (70) or guide (120) and the inner surface (30) of the sound port generally contracting as the waveguide (85) gets closer to the smaller opening (60).

Figure 24:
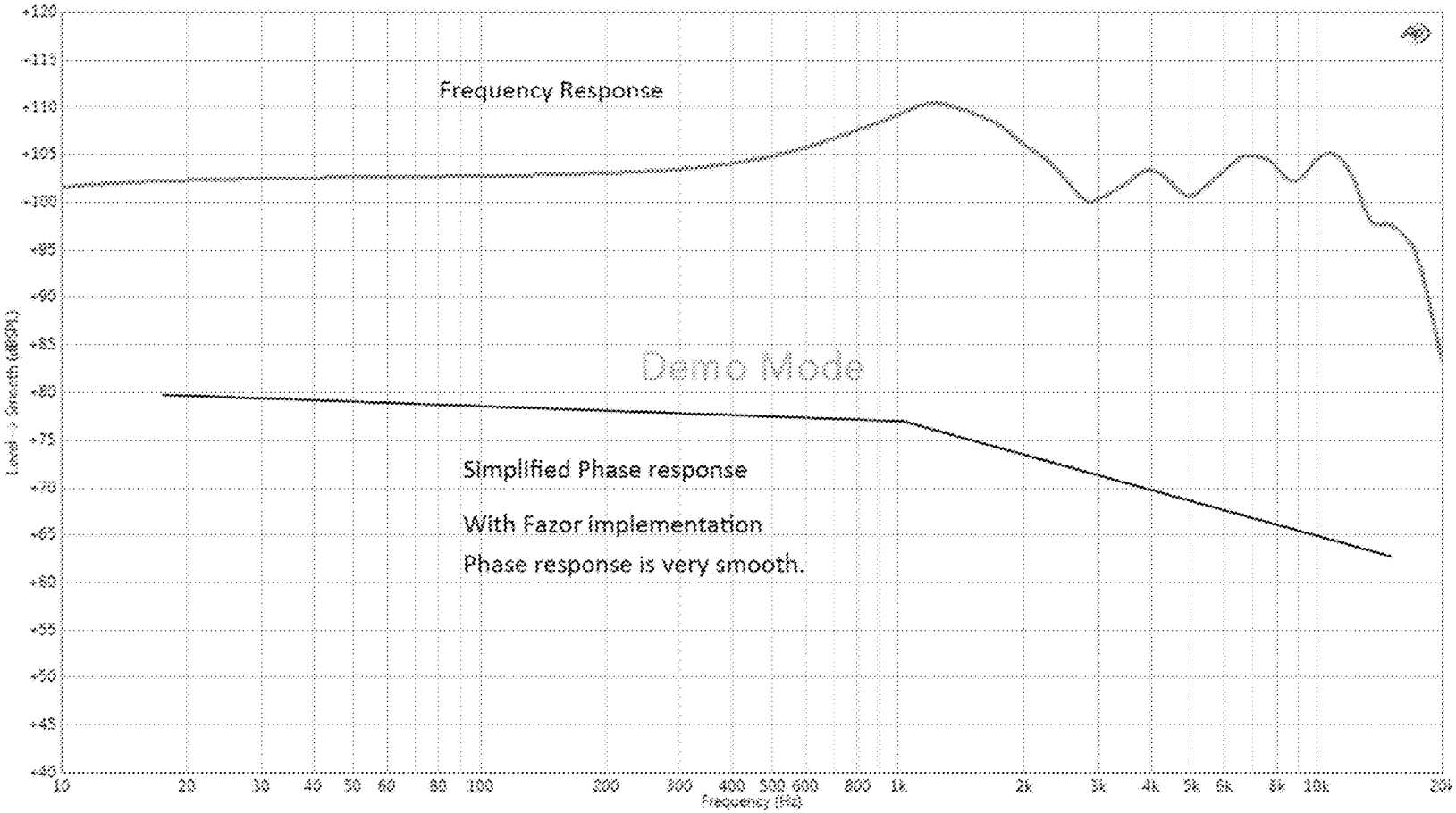
FIG. 24 shows a graph of the excellent frequency response and phase response of a preferred embodiment of the non-axisymmetric phase plug (70) or Fazor™ (70) implementation.

FIG. 24 shows a graph with the upper line describing the frequency response of a Fazor™ (70) implementation, while the lower line shows the smooth phase response of the Fazor™ (70) implementation. This is the typical frequency response of the preferred embodiment with the Fazor™ (70). Here, the high frequency response extends relatively smoothly.

Figure 25:
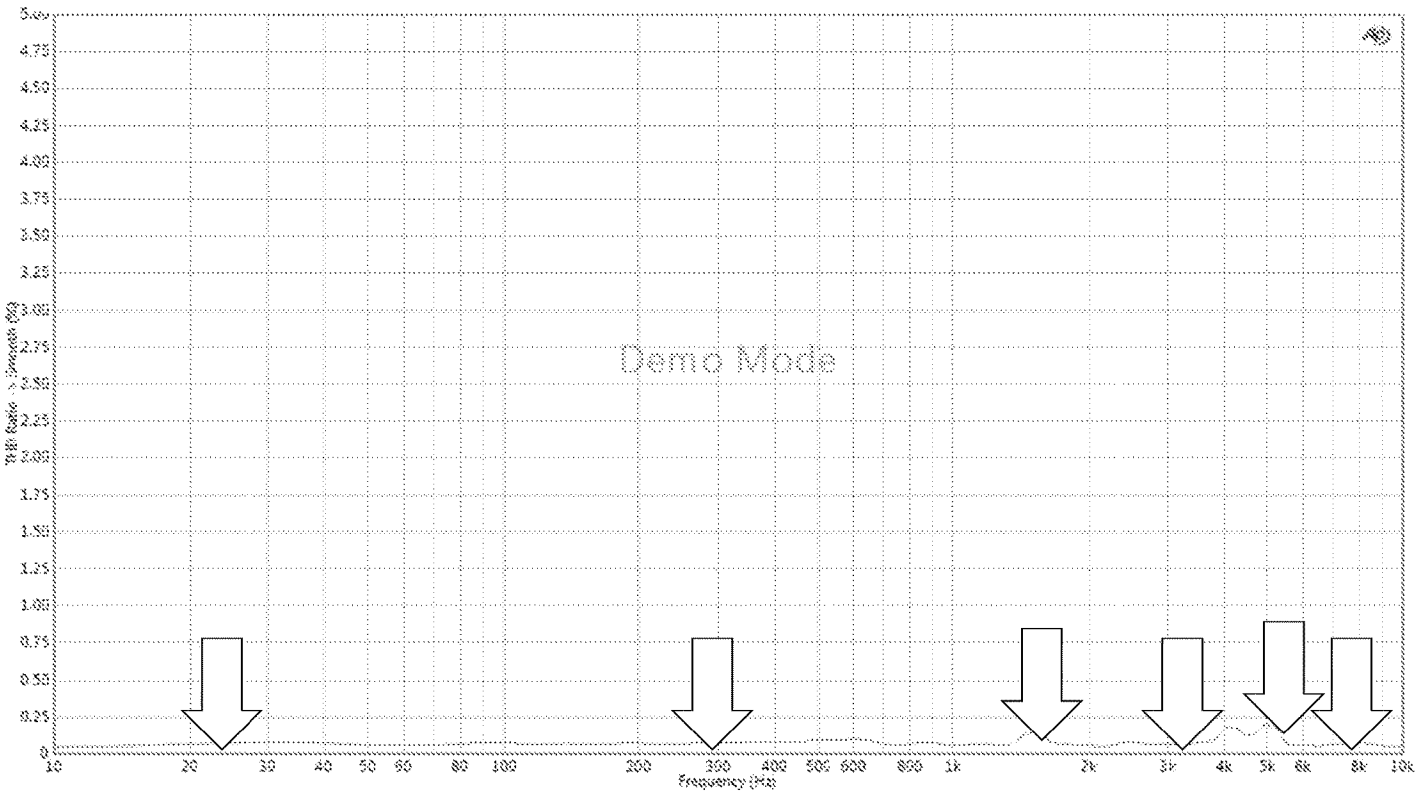
FIG. 25 shows a graph of the extremely low distortion level of the non-axisymmetric phase plug device or Fazor™ (70) implementation.

FIG. 25 shows a graph of a typical, extremely low distortion level with the Fazor™ (70), as well as Fluxor™ magnets and planar magnetic electro-acoustic transducer assembly (90).

Figure 26:
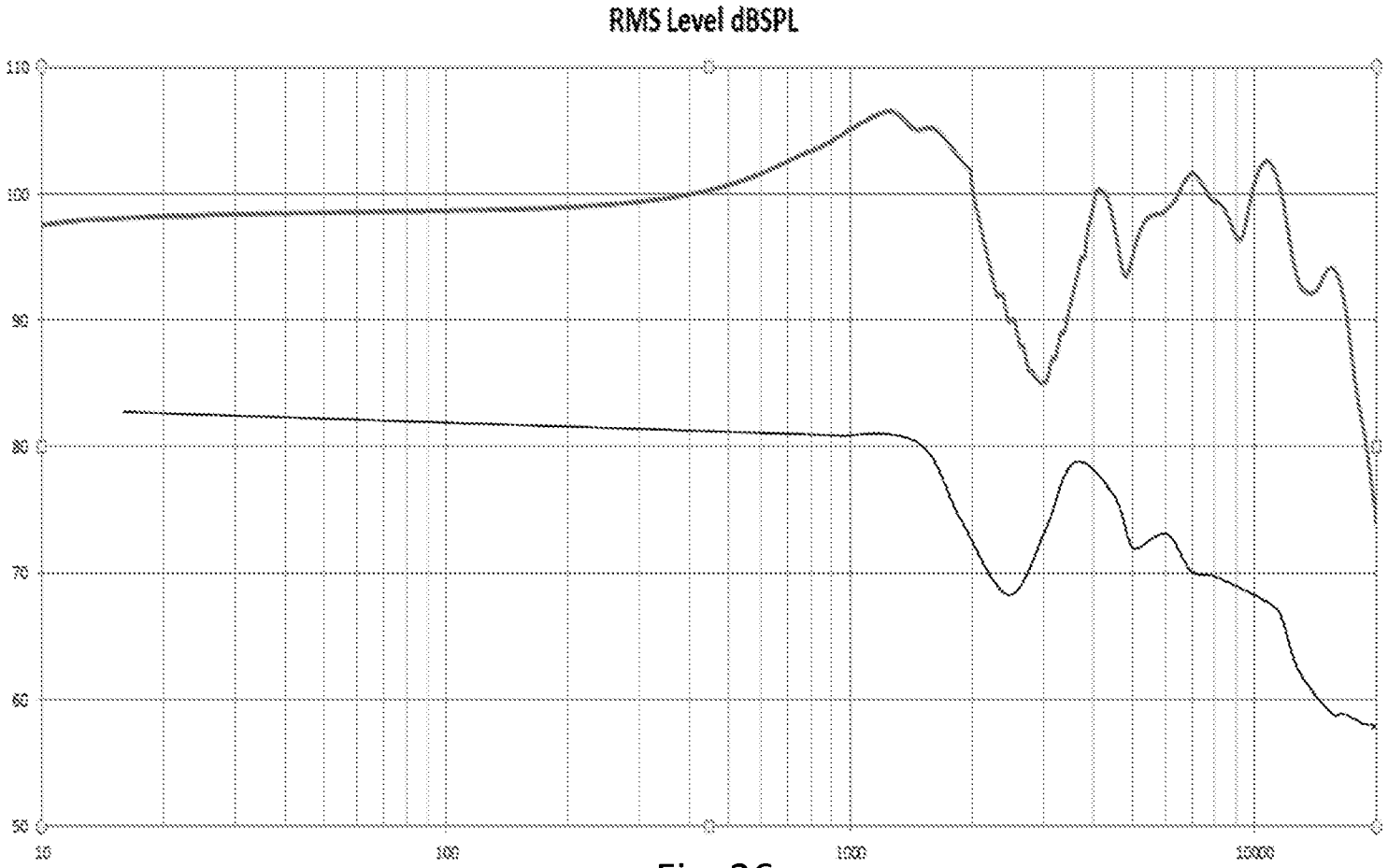
FIG. 26 shows a graph of the poor frequency response and phase response without the non-axisymmetric phase plug implementation.

FIG. 26 shows a graph of the frequency response curves of a non-Fazor™ (70) implementation in the upper line, and the phase response curves of a non-Fazor™ (70) implementation in the lower line. Without Fazor™ (70) the same earphones exhibit poor frequency response, peaky high frequencies and faster roll-off, and phase response also deteriorates above 1000 Hz.

Aspects of the present invention further comprise a method patent comprising the steps of reforming the bottom assembly such that the in-ear device (105) phase-shifts the acoustic signals for different acoustic qualities, e.g., different frequency response, decreased sound diffraction, improved acoustic loading, improved reflection characteristics, and decreased sound distortion.

Aspects of the present invention further comprise a method patent comprising the steps of reforming the internal generally-conical tapered element (70) such that the in-ear device (105) phase-shifts the acoustic signals for different acoustic qualities, such as frequency response, decreased sound diffraction, improved acoustic loading, improved reflection characteristics, and decreased sound distortion.

Aspects of the present invention may also comprise a system of interacting and adjustable parts such that the in-ear device (105) interactively phase-shifts the acoustic signals for different acoustic qualities, such as frequency response, decreased sound diffraction, improved acoustic loading, improved reflection characteristics, and decreased sound distortion.

Present embodiments satisfy the above described needs and provide further related advantages.

The foregoing descriptions of embodiments of the present invention have been provided for purposes of illustration and description. It is not intended to be exhaustive or to limit the invention to the precise forms disclosed. Various additional modifications of the described embodiments specifically illustrated and described herein will be apparent to those skilled in in the art, particularly in light of the teachings of this invention. It is intended that the invention cover all modifications and embodiments, which fall within the spirit and scope. Thus, while embodiments of the present invention have been disclosed, it will be understood that these are not limited to the description herein, but may be otherwise modified based upon this invention.

I claim:

1. An in-ear audio device (105) comprising:

a hollow sound port (17) formed to fit within an ear canal of a user, the hollow sound port (17) having a first opening (50) directed away from the ear canal of the user, and a second opening (60) directed toward the ear canal;

a planar magnetic transducer assembly (90) disposed at the first opening (50); and a non-axisymmetric phase-shift plug (70) disposed within the hollow sound port (17) between the transducer assembly (90) and the second opening (60).

2. The in-ear audio device (105) of claim 1 wherein the phase-shift plug (70) is secured within the hollow sound port (17) with one or more spokes (80).

3. An in-ear audio device (105) comprising:

a housing (101) having a first acoustic opening (60);

a transducer assembly (90) disposed in the housing (101) such that the transducer assembly (90) is located distally from the first acoustic opening (60); and a phase plug (70) disposed within the housing (101) between the transducer assembly (90) and the first acoustic opening (60), such that the phase plug (70) is non-axisymmetric.

4. The in-ear audio device (105) of claim 3 wherein the transducer assembly (90) includes a diaphragm (94), such that the diaphragm (94) defines a diaphragm central axis (99) perpendicular thereto; and the phase plug (70) is non-axisymmetric with the diaphragm central perpendicular axis (99).

5. The in-ear audio device (105) of claim 4 wherein the diaphragm (94) is substantially planar.

6. The in-ear audio device (105) of claim 4 wherein the diaphragm (94) is non-planar.

7. The in-ear audio device (105) of claim 4 wherein the first acoustic opening (60) defines a first acoustic opening center point (198) at the center of the first acoustic opening (60) such that the first acoustic opening center point (198) is located off-axis from the diaphragm central perpendicular axis (99).

8. The in-ear audio device (105) of claim 3 wherein the phase plug (70) includes:

a compression member (2) wherein the compression member (2) further defines a compression member periphery (16); and a phase plug guide (120) extending from the compression member periphery (16) to a tip (84), and configured such that the phase plug guide (120) is exponentially tapered.

9. The in-ear audio device (105) of claim 8 wherein the phase plug guide (120) is non-axisymmetric to a central axis (93) defined perpendicular to the compression member (2).

10. The in-ear audio device (105) of claim 8, wherein the housing (101) includes an inner wall (30), such that a waveguide (85) is defined between the inner wall (30) and the phase plug guide (120), and wherein shortest path measurements (19*f*-19*g*) of the waveguide (85) from points on the compression member periphery (16) to the first acoustic opening (60) are substantially equal.

11. The in-ear audio device (105) of claim 10 wherein the inner wall (30) tapers smaller in area toward the first acoustic opening (60).

12. The in-ear audio device (105) of claim 3 wherein the phase plug (70) includes:

a compression member (2) wherein the compression member (2) further defines a compression member periphery (16); and a phase plug guide (120) extending from the compression member periphery (16) to a tip (84), and configured such that the phase plug guide (120) is conically tapered.

13. The in-ear audio device (105) of claim 3 wherein the transducer assembly (90) is a selected from the group consisting of dynamic transducer, planar transducer, planar magnetic transducer, cone voice coil transducer, dome voice coil transducer, electrostatic transducer, and piezo electric transducer.

14. The in-ear audio device (105) of claim 3 wherein the housing (101) further comprises an annular indentation ring (402) disposed around a circumference of the housing (101) distal from the first acoustic opening (60).

15. The in-ear audio device (105) of claim 14 wherein a flexible partial ring (401) fitted for the annular indentation ring (402) is releasably attachable to the annular indentation ring (402).

16. The in-ear audio device (105) of claim 15 wherein the flexible partial ring (401) is attached to a spoke (403) having two ends, such that a first end of the spoke (403) is attached to the flexible partial ring (401), and a second end of the spoke (403) is attached to an earhook (170).

17. The in-ear audio device (105) of claim 3 wherein the housing (101) further comprises a bottom housing (15);

a second opening (50) in the bottom housing (15) positioned distally from the first acoustic opening (60); and a top housing (110) wherein the top housing (110) is formed to cover the second opening (50) in the bottom housing (15) such that the top housing (110) is releasably attached to the bottom housing (15).

18. An in-ear audio device (105) comprising:

a housing (15);

an electro-acoustic transducer assembly (90) disposed in a first end of said housing (15); and a phase plug (70) having a compression member (2), a tip (84), and a guide (120) extending from the compression member (2) to the tip (84), wherein the guide (120) is non-axisymmetric to a central axis (93) defined perpendicular to the compression member (2);

said housing (15) having an internal cavity (40) tapering from the transducer assembly (90) to a smaller acoustic opening (60) at a second end of the housing (15);

said phase plug (70) disposed within said cavity (40) such that the compression member is proximate the transducer assembly (90) and the tip is proximate the acoustic opening.

19. The in-ear audio device (105) of claim 18 wherein the tip (84) is not located on the central perpendicular axis (93).

20. The in-ear audio device (105) of claim 18 wherein the compression member (2) is substantially planar.

21. The in-ear audio device (105) of claim 18 wherein the compression member (2) is substantially non-planar.

22. The in-ear audio device (105) of claim 18 wherein the guide (120) is configured such that shortest path surface measurements (19*a*, 19*b*, 19*c*, 19*d*, 19*e*) measured along shortest path surfaces on the guide (120) from the tip (84) to the compression member (2) are substantially equal.

23. The in-ear audio device (105) of claim 18, further comprising at least one waveguide (27) disposed inside the phase plug (70).

24. The in-ear audio device (105) of claim 18 wherein the compression member (2) further comprises a compression member periphery (16); and the guide (120) has a plurality of cross-sectional areas (10-14) defined parallel to the compression member periphery (16), each cross-sectional area (10-14) having a center point (5-9) such that a successive tracing of the center points (5-9) from the compression member (2) to the tip (84) defines a non-rectilinear line (15).

25. The phase plug (70) of claim 24 wherein the guide (120) has a planar perimeter (83) substantially parallel to the compression member periphery (16), the guide (120) being configured such that coplanar slopes (64, 74) of the planar perimeter (83) are unequal.

26. The phase plug (70) of claim 24 wherein the compression member periphery (16) defines a compression member periphery plane (91); and wherein intersecting planes (85, 86, 87, 88) parallel to the compression member periphery plane (91) intersect the guide (120) such that at least one front slope (65, 66, 67, 68) of guide (120) at the intersecting planes (85, 86, 87, 88) is unequal to its opposite side rear slope (75, 76, 77, 78) of the guide (120).

* * * * *